US012708838B2

(12) United States Patent
Shigeta

(10) Patent No.: US 12,708,838 B2
(45) Date of Patent: Aug. 18, 2026

(54) SECURITY ELECTRONIC SHOE FOR CASINO

(71) Applicant: ANGEL GROUP CO., LTD., Shiga (JP)

(72) Inventor: Yasushi Shigeta, Shiga (JP)

(73) Assignee: ANGEL GROUP CO., LTD., Shiga (JP)

( * ) Notice: Subject to any disclaimer, the term of this patent is extended or adjusted under 35 U.S.C. 154(b) by 414 days.

(21) Appl. No.: 18/218,801

(22) Filed: Jul. 6, 2023

(65) Prior Publication Data

US 2024/0009548 A1 Jan. 11, 2024

(30) Foreign Application Priority Data

Jul. 8, 2022 (JP) ..... 2022-110486
Aug. 23, 2022 (JP) ..... 2022-132265
May 26, 2023 (JP) ..... 2023-086884

(51) Int. Cl.
*A63F 1/14* (2006.01)

(52) U.S. Cl.
CPC ..... *A63F 1/14* (2013.01)

(58) Field of Classification Search
CPC ..... A63F 1/14
See application file for complete search history.

(56) References Cited

U.S. PATENT DOCUMENTS 6,402,142 B1 * 6/2002 Warren ..... A63F 1/14 273/148 R
2007/0216092 A1 * 9/2007 Fleckenstein ..... A63F 1/14 273/148 R
2014/0091523 A1 * 4/2014 Madding ..... A63F 1/10 273/149 R
2014/0291930 A1 10/2014 Berube et al.
(Continued)

FOREIGN PATENT DOCUMENTS

CN 104245064 A 12/2014
CN 105582666 A 5/2016
(Continued)

OTHER PUBLICATIONS

International Search Report dated Sep. 26, 2023 issued for PCT/JP2023/025053.
(Continued)

*Primary Examiner* — Audrey B. Walter
(74) *Attorney, Agent, or Firm* — NORTON ROSE FULBRIGHT US LLP

(57) ABSTRACT

A security electronic shoe configured to house a plurality of playing cards including a housing configured to house a stacked plurality of playing cards; an opening configured to expose a leading playing card among the plurality of playing cards; a draw guide configured to guide the leading playing card from the opening; and a weight configured to push a last playing card of the plurality of playing cards toward the opening, wherein a bottom of the housing slopes toward the opening, the weight is configured to be movable on the
(Continued)

bottom of the housing toward the opening in a state pushing the last playing card toward the opening, and the housing has a structure in which when an upper surface and at least one side surface are opened, the plurality of playing cards can be loaded into the housing.

13 Claims, 40 Drawing Sheets

(56) References Cited

U.S. PATENT DOCUMENTS

| | | | | |
|---|---|---|---|---|
| 2015/0097335 | A1 | 4/2015 | Shigeta | |
| 2015/0258420 | A1 | 9/2015 | Shigeta | |
| 2017/0095727 | A1* | 4/2017 | Shigeta | A63F 1/14 |
| 2017/0259164 | A1 | 9/2017 | Hsu | |
| 2020/0338437 | A1 | 10/2020 | Shigeta | |
| 2023/0218980 | A1* | 7/2023 | Petrovs | A63F 1/10 273/149 R |

FOREIGN PATENT DOCUMENTS

| | | | | |
|---|---|---|---|---|
| CN | 206511285 | U | 9/2017 | |
| EP | 1940523 | B1 | 5/2011 | |
| GB | 2382567 | A | 6/2003 | |
| JP | 2021168967 | A | 10/2021 | |
| KR | 20170046264 | A * | 5/2017 | A63F 1/14 |
| WO | 1999019033 | A1 | 4/1999 | |
| WO | 2013161284 | A1 | 10/2013 | |
| WO | 2016049619 | A1 | 3/2016 | |

OTHER PUBLICATIONS

European Search Report dated Dec. 12, 2023 issued for EP Applicatoin No. 23183414.4.

Extended European Search Report dated Sep. 30, 2025, issued in EP Application No. 25178804.8.

Chinese Office Action dated Apr. 18, 2026, issued in CN Application No. 202510730902.9.

Chinese Office Action dated Jan. 31, 2026, issued in CN Application No. 202510730900.X.

* cited by examiner

SECURITY ELECTRONIC SHOE FOR CASINO

CROSS-REFERENCE OF RELATED APPLICATIONS

This application claims the benefit of JP Pat. App. No. 2022-110486 filed Jul. 8, 2022, JP Pat. App. No. 2022-132265 filed Aug. 23, 2022, and JP Pat. App. No. 2023-086884 filed May 26, 2023, the contents of each application are incorporated herein by reference.

FIELD

The present invention relates to a security electronic shoe for a casino configured to house a plurality of playing cards to be drawn one by one for a game.

BACKGROUND

In a casino, a game using playing cards is performed at a gaming table. The playing cards used in the game is housed in a shoe at the gaming table. Eight decks of the playing cards are housed in the shoe, for example. A dealer draws the playing cards one by one from the shoe and progresses the game.

When the playing cards housed in the shoe are used up according to the progress of the game, the dealer loads new playing cards into the shoe. Specifically, when loading the playing cards into the shoe, the dealer inserts a cut card in a position slightly forward the last of the loaded playing cards. When the game is progressed and the cut card is drawn, the dealer stops the game after that while leaving remaining playing cards in the shoe, and removes the remaining playing cards from the shoe and loads new playing cards.

The playing cards to be loaded into the shoe are pre-shuffled and packaged. When loading the new playing cards into the shoe, it is necessary to open the package, take out several (for example, eight decks of) shuffled playing cards, and houses them in the shoe.

SUMMARY

Since the playing cards housed in the shoe are used for the game in the casino, a contents and order of the playing cards housed in the shoe must not be known to any person. That is, high security is required for the casino shoe. In particular, when opening the package, taking out the plurality of playing cards and loading them into the shoe, it is necessary to prevent a player and the dealer from knowing the contents of the playing cards.

Moreover, the game must be interrupted while the new playing cards are loaded into the shoe. In a case where this interruption is long, game participants become bored and casino sales decreases. Therefore, it is desirable that the loading of the playing cards into the shoe can be performed smoothly.

The purpose of the present invention is to provide a security electronic shoe for a casino which can load a playing card smoothly while ensuring security.

A security electronic shoe for a casino according to an aspect of the present invention is a security electronic shoe for a casino configured to house a plurality of playing cards to be drawn one by one for a game, comprising: a housing portion configured to house a stacked plurality of playing cards; an opening portion configured to expose a leading playing card among the plurality of playing cards housed in the housing portion; a draw guide portion configured to guide draw of the leading playing card from the opening portion; and a weight configured to push a last playing card of the plurality of playing cards toward the opening portion, wherein a bottom portion of the housing portion slopes so as to descend toward the opening portion, the weight is configured to be movable on the bottom portion of the housing portion toward the opening portion in a state pushing the last playing card toward the opening portion, according to that the last playing card moves toward the opening portion, accompanying that the leading playing card is drawn in sequence, and the housing portion has a structure in which an upper surface and at least one side surface are opened, and the plurality of playing cards can be loaded into the housing portion through the opened portion.

In the above security electronic shoe for the casino, the housing portion may include a stopper at a position of the plurality of playing cards corresponding to a lower portion of the opened side surface, the stopper configured to restrict a lateral movement of the plurality of playing cards.

In the above security electronic shoe for the casino, the plurality of playing cards may be to be housed in the housing portion such that back surfaces thereof face the opening portion, and the weight may be configured to contact with a front surface of the last playing card such that the front surface of the last playing card cannot be seen.

The above security electronic shoe for the casino may further comprise a side cover configured to be movable between a cover position where the side cover covers the opened side surface of the housing portion and an open position where the side cover opens the opened side surface of the housing portion.

In the above security electronic shoe for the casino, the side cover may be capable of performing a rotating movement between the cover position and the open position.

In the above security electronic shoe for the casino, the side cover may be capable of performing a parallel movement between the cover position and the open position.

The above security electronic shoe for the casino may further comprise a side cover configured to be movable between a cover position where the side cover covers the opened side surface of the housing portion and an open position where the side cover opens the opened side surface of the housing portion, and a surface of the side cover opposed to the side surface may be positioned more outside than a surface of the stopper opposed to the side surface when the side cover is in the cover position.

In the above security electronic shoe for the casino, the side surface may be a side surface on a right side facing in a direction of the draw.

In the above security electronic shoe for the casino, the draw guide portion may be configured to be removable.

In the above security electronic shoe for the casino, the draw guide portion may include a metal part configured to restrain the playing card to be drawn to prevent two playing cards from being drawn at a same time.

In the above security electronic shoe for the casino, the housing portion may include an upper surface cover configured to be movable between a cover position where the upper surface cover covers upper surfaces of the plurality of playing cards and an open position where the upper surface cover opens the upper surfaces of the plurality of playing cards.

In the above security electronic shoe for the casino, the housing portion may include a holding means configured to hold the weight in a rear position of the housing portion in order to load the plurality of playing cards into the housing portion.

The above security electronic shoe for the casino may further comprise an upper surface cover configured to be fixable in a cover position where the upper surface cover covers the upper surface of the housing portion, and the holding means may be configured to release holding of the weight according to that the upper surface cover comes to the cover position.

The above security electronic shoe for the casino may further comprise a side surface cover configured to be movable between a cover position where the side surface cover covers the opened side surface of the housing portion and an open position where the side surface cover opens the opened side surface of the housing portion, and the upper surface cover may be configured to be fixable in the cover position of the upper surface cover by positioning the side cover in the cover position of the side cover.

DESCRIPTION OF EMBODIMENTS

An electronic shoe according to embodiments of the present invention is described below. In the present embodiments, the electronic shoe configured to house a plurality of playing cards to be drawn one by one by a dealer for a game at a gaming table of a casino (hereinafter simply referred to as "electronic shoe") is described. This electronic shoe is used at the gaming table in the casino. The game may be, for example, baccarat, blackjack, and so on, but, in the present embodiments, the electronic shoe used for baccarat is described.

Figure 1:
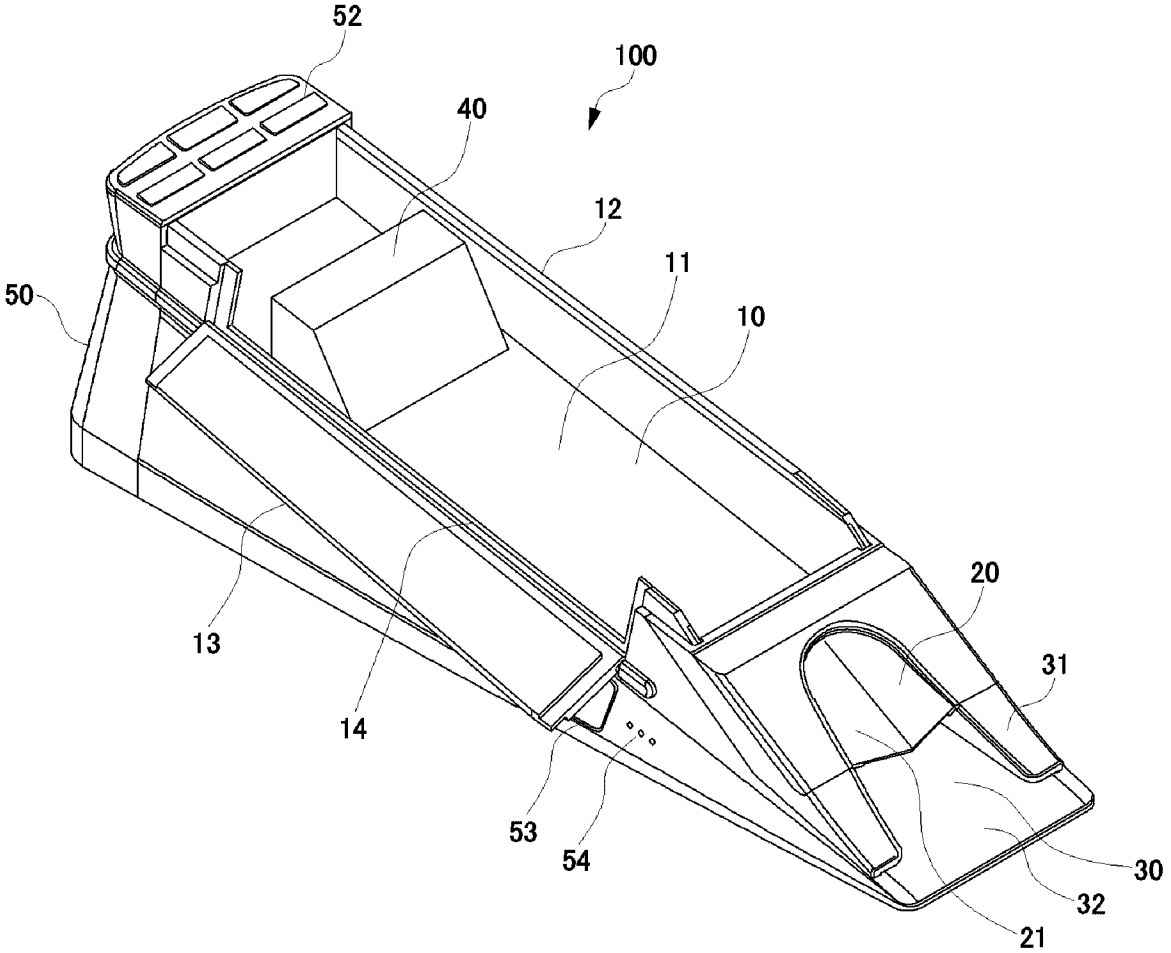
FIG. 1 is a perspective view showing an electronic shoe according to a first embodiment of the present invention.
Figure 2:
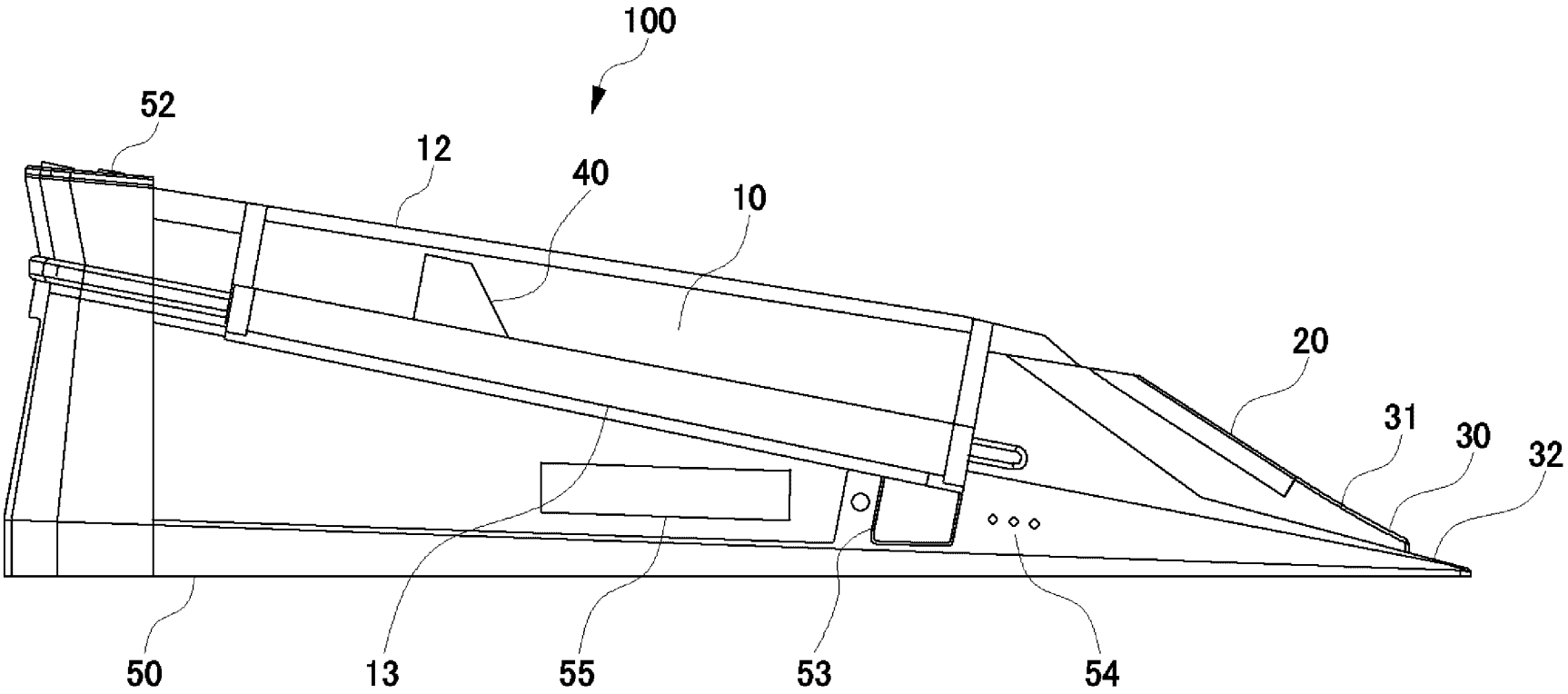
FIG. 2 is a side view showing the electronic shoe according to the first embodiment of the present invention.
Figure 3:
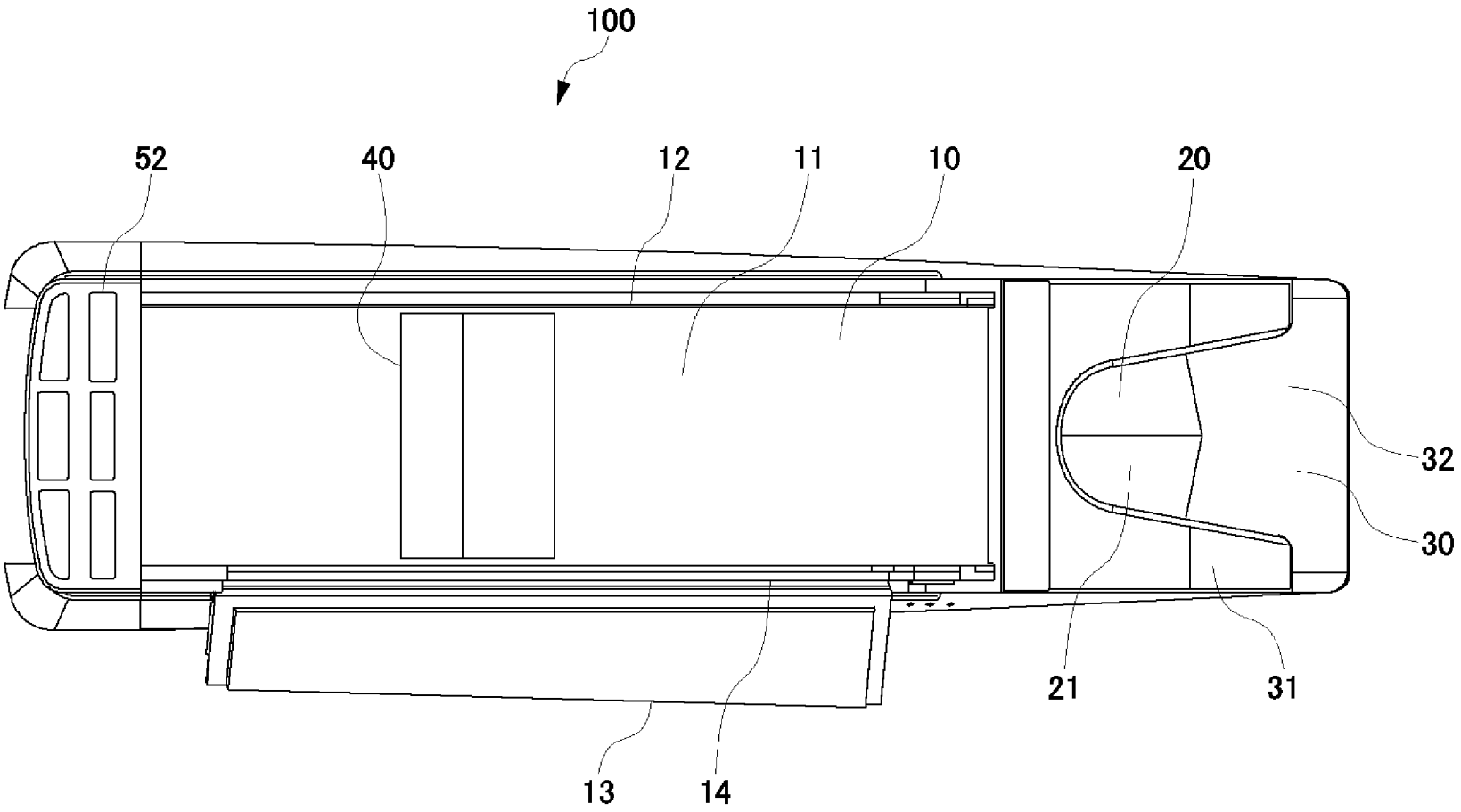
FIG. 3 is a plan view showing the electronic shoe according to the first embodiment of the present invention.
Figure 4:
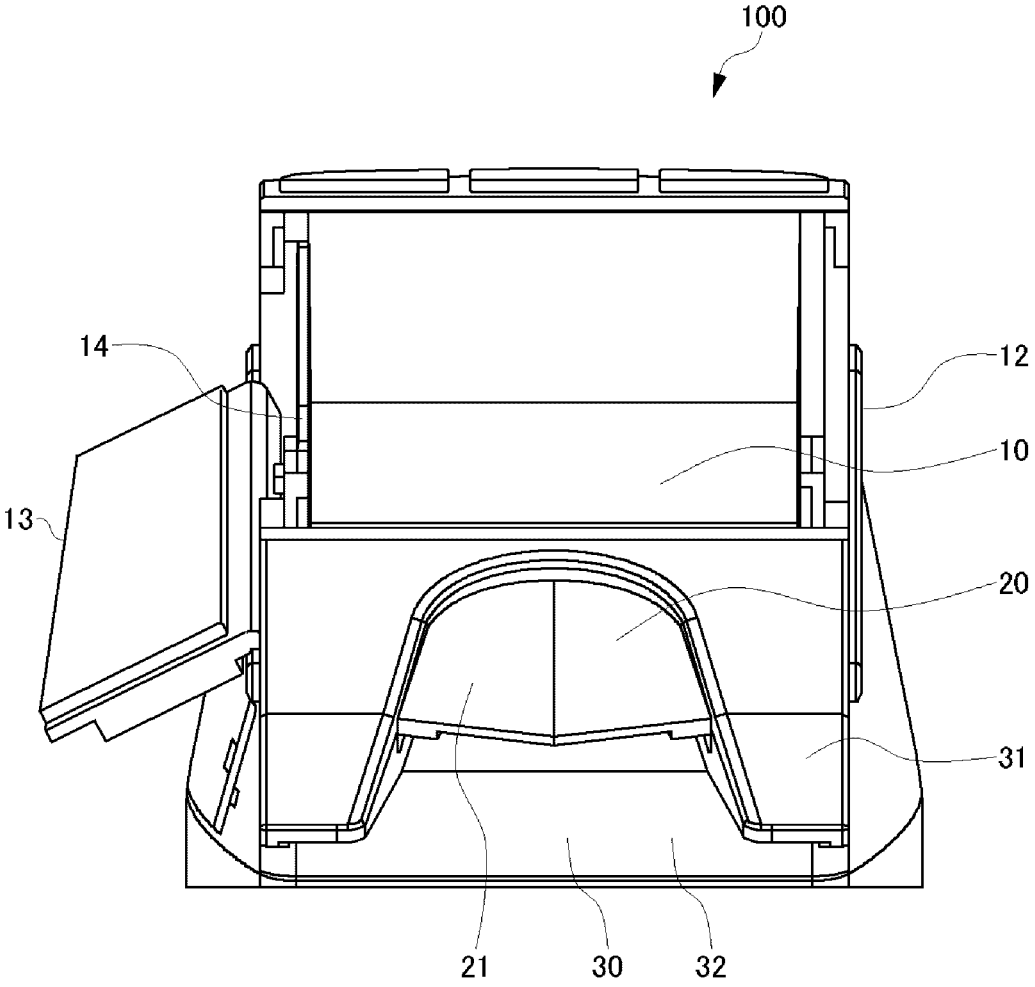
FIG. 4 is a front view showing the electronic shoe according to the first embodiment of the present invention.

FIG. 1 is a perspective view showing an electronic shoe according to a first embodiment, FIG. 2 is a side view showing the electronic shoe according to the first embodiment, FIG. 3 is a plan view showing the electronic shoe according to the first embodiment, and FIG. 4 is a front view showing the electronic shoe according to the first embodiment. The electronic shoe 100 has a rectangular shape as a whole. The electronic shoe 100 houses a plurality of playing cards such that the short side thereof are parallel to the long sides of the playing cards. The playing cards are removed to the outside of the electronic shoe 100 one by one by a draw operation by a dealer from the front end of the electronic shoe 100.

The electronic shoe 100 includes a housing portion 10, an opening portion 20, a draw guide portion 30, a weight 40, and a main body 50. The lower half part and rear part of the electronic shoe 100 form the main body 50. The housing portion 10 is formed so as to extend forward contiguously from the rear end part of the main body 50. The housing portion 10 houses a stacked plurality of playing cards. As described above, the stacked plurality of playing cards is housed in the housing portion 10 in the lateral orientation. The long sides of the playing cards are supported on the bottom surface 11 of the housing portion 10. The playing cards are housed in the housing portion 10 such that the back surfaces of the playing cards face forward.

The bottom surface 11 of the housing portion 10 slopes so as to descend toward the opening portion 20. The housing portion 10 has a structure in which the upper surface and left side surface (that is, the right side facing in the direction in which the playing cards are drawn) are opened. That is, the right side surface of the housing portion 10 includes a side wall 12 whose height corresponds to the height of the housed playing cards (the length of the short sides of the playing cards). At the left side surface, a side wall 14 whose height is low is also provided to stand from the bottom surface 11, and the side wall 14 has the height corresponding to the height of the housed playing cards, at the part close to the opening portion 20.

The part whose height is low of the side wall 14 forms a side surface opened portion of the left side surface, and an upper surface opened portion is formed to be contiguous to the side surface opened portion and opens the housing portion 10 upward. The plurality of playing cards can be loaded into the housing portion 10 through the side surface opened portion and the upper surface opened portion.

Figure 5:
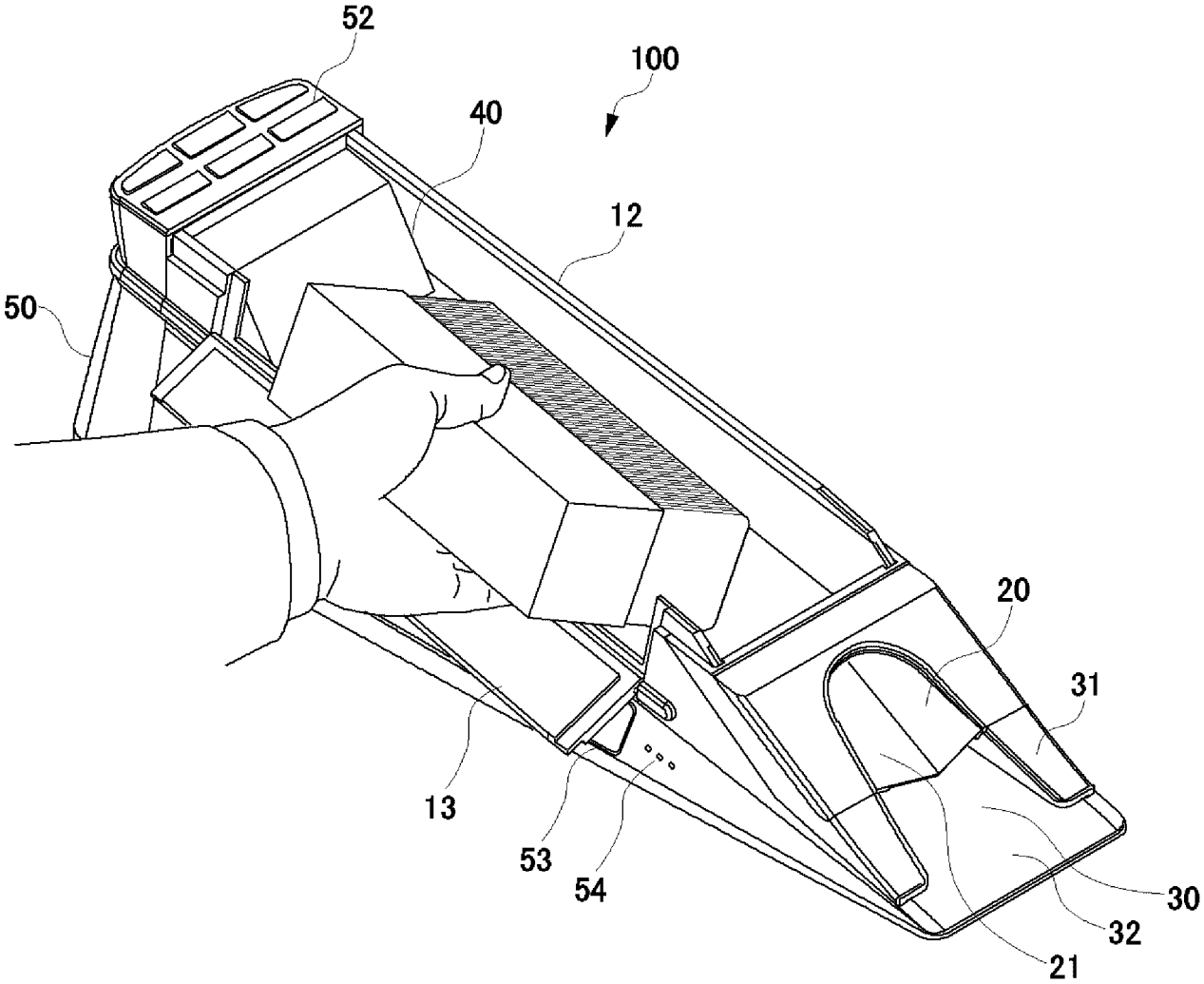
FIG. 5 is a view showing a state in which a plurality of playing cards is loaded into the electronic shoe according to the first embodiment of the present invention.

FIG. 5 is a view showing a state in which the plurality of playing cards is loaded into the electronic shoe according to the first embodiment of the present invention. The plurality of playing cards is pre-shuffled and housed in a package P. The package P is sealed, and is opened by the dealer when loaded into the electronic shoe 100. In the package P shown in FIG. 5, the upper half thereof at the plurality of playing cards is removed, and only the lower half thereof houses the plurality of playing cards.

As shown in FIG. 5, the dealer inserts the plurality of playing cards which only half is housed in the package P into the housing portion 10 from the side surface opened portion and the upper surface opened portion. At this time, the dealer once places and fixes the package P housing the playing cards on the side surface opened portion, and then pulls out the package P while pushing the multiple playing cards against the side wall 12 on the back side in the housing portion 10 and align them to house them in the housing portion 10.

The side wall 14 whose height is low is formed at a position of the plurality of playing cards corresponding to the lower portion of the side surface opened portion, and functions as a stopper to restrict a lateral movement of the housed plurality of playing cards. Thereby, even when the side surface cover 13 is in an opening state, the playing cards are neatly housed in the housing portion 10, and so the playing cards do not move left or right, or up and down, and the playing cards do not come out from the housing portion 10. Furthermore, as is described below, by pushing the last playing card toward the opening portion 20 by the weight 40, the playing cards move in sequence in a forward and rearward direction without coming out of the housing portion 10, accompanying that they are drawn out in sequence from the leading end.

The housing portion 10 is provided with the side surface cover 13 including an axis on the outside of the side wall 14 formed to be low. The side surface cover 13 rotates around this axis to perform a rotating movement between a cover position and an open position. In the cover position, the side surface cover 13 is in an attitude to be upright, and closes the side surface opened portion to cover the housed playing cards. In the open position, the side surface cover 13 is in an attitude to be rotated further from the horizontal attitude to open the side surface opened portion.

The opening portion 20 exposes to the outside the leading playing card among the plurality of playing cards housed in the housing portion 10. The opening portion 20 is shaped to be an arch-shape and exposes the center portion of a back surface of the playing card. The dealer can draw out the leading playing card onto the gaming table with its back surface facing up by sliding it while pressing downward on its exposed portion.

A blind 21 is formed in the opening portion 20 so as to cover over the back surface of the leading playing card exposed therethrough. The blind 21 is made of a large number of flexible thin line-shaped members, and divided into the left and right at the center. The line-shaped members are provided so as to slope in a drawing direction from the left and right to the center and from the base to the tip. The dealer can apply force to the playing card around a break of the left and right of the line-shaped members to draw out it.

The draw guide portion 30 guides a draw of the leading playing card from the opening portion 20. Specifically, the draw guide portion 30 includes a slop portion 32 sloping so as to be continuous from the opening portion 20 to the upper surface of the gaming table, and a restricting portion 31 configured to restrict upward and sideward movements of the playing card to be drawn out and so guide it in the draw direction. The playing card is drawn out while being guided by the draw guide portion 30, and so is drawn out onto the gaming table while the front side printed with a rank and suit faces down. Fine embossing is applied to the slop portion 32, and thereby the front side of the playing cards is easier to slide.

Figure 6:
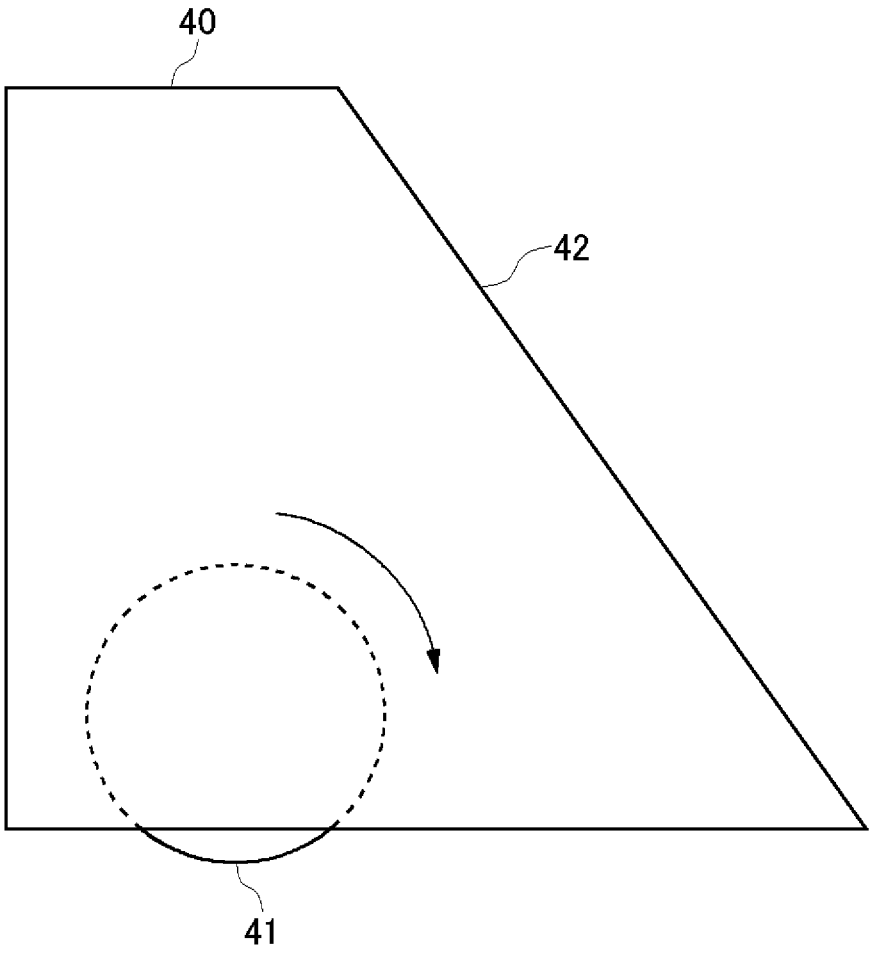
FIG. 6 is a view showing a structure of a weight according to the first embodiment of the present invention.

FIG. 6 is a view showing a structure of the weight according to the first embodiment of the present invention. The weight 40 is used for pushing the last playing card among the plurality of playing cards toward the opening portion 20. The weight 40 includes a roller 41 including a lateral axis. The lower end portion of the roller 41 protrudes slightly from the bottom of the weight 40. Thereby, the weight 40 is movable in the forward and rearward direction by rotating the roller 41.

The lateral width of the weight 40 corresponds to the lateral width of the housing portion 10. The weight 40 includes a slope surface 42 in the front thereof. As described above, the playing cards are housed in the housing portion 10 such that the back surfaces face the opening portion 20, and so the front surface of the last playing card contacts with the slope surface 42 of the weight 40.

The weight 40 is movable forward and rearward on the bottom surface 11 of the housing portion 10. As described above, the housing portion 10 slopes toward the opening portion 20, and so the weight 40 moves to the opening portion 20 by its own weight. When the plurality of playing cards is loaded in the housing portion 10, the slope surface 42 of the weight 40 pushes the last playing card toward the opening portion 20. Thus, due to the action of the weight 40, the leading playing card is always pushed from the rear side toward the opening portion 20 and exposed through the opening portion 20.

The weight 40 can be fixed in the rear position of the housing portion 10 by magnets or an engaging mechanism. As shown in FIG. 5, when loading the playing cards into the housing portion 10, the weight 40 is fixed in this fixed position to form a space in which a new plurality of playing cards can be housed in the housing portion 10. Furthermore, it may be that a sensor detects that the plurality of playing cards is housed in the housing portion 10, and the fixation of the weight by the magnets or the engaging mechanism is automatically released based on this detection of the sensor. When the fixation is released, the weight 40 moves toward the opening portion 20 on the bottom surface 11 of the housing portion 10 by its own weight, contacts the last playing card and pushes the loaded plurality of playing cards toward the opening portion 20 from the last thereof. It may be to detect that the playing cards are housed in the housing portion 10 by detecting that the side surface cover 13 closes the side surface opened portion, or that the upper surface cover described below closes the upper surface opened portion, for example.

The roller 41 of the weight 40 may be a structure in which it is rotatable only in a direction to move the weight 40 forward (to the side including the slope surface 42) and not rotatable in a direction to move the weight 40 rearward. Thereby, the weight 40 does not move rearward even if a force is applied to the weight 40 in the rearward direction when the playing cards are drawn out from the lead.

A plurality of result indicating lamps 52 is provided on the upper surface portion of the main body 50. A result indicating button 53, result indicating lamps 54, and a result indicating display 55 are provided on the left side surface of the main body 50.

The side surface opened portion and the side surface cover 13, and the result indicating button 53 are all provided on the side facing the dealer when the electronic shoe 100 is placed on the gaming table. That is, the electronic shoe 100 is placed on the left side of the dealer, and so the side surface opened portion and the result indicating button 53 are provided on the left side facing the dealer. Thereby, it become easy for the dealer to operate the result indicating button 53 of the electronic shoe 100 placed on the gaming table and to load the new playing cards into the housing portion 10 through the side surface opened portion.

The result indicating display 55 is also provided on the left side facing the dealer. Thereby, it is possible to show a game result to the dealer without being seen by a player.

Figure 7:
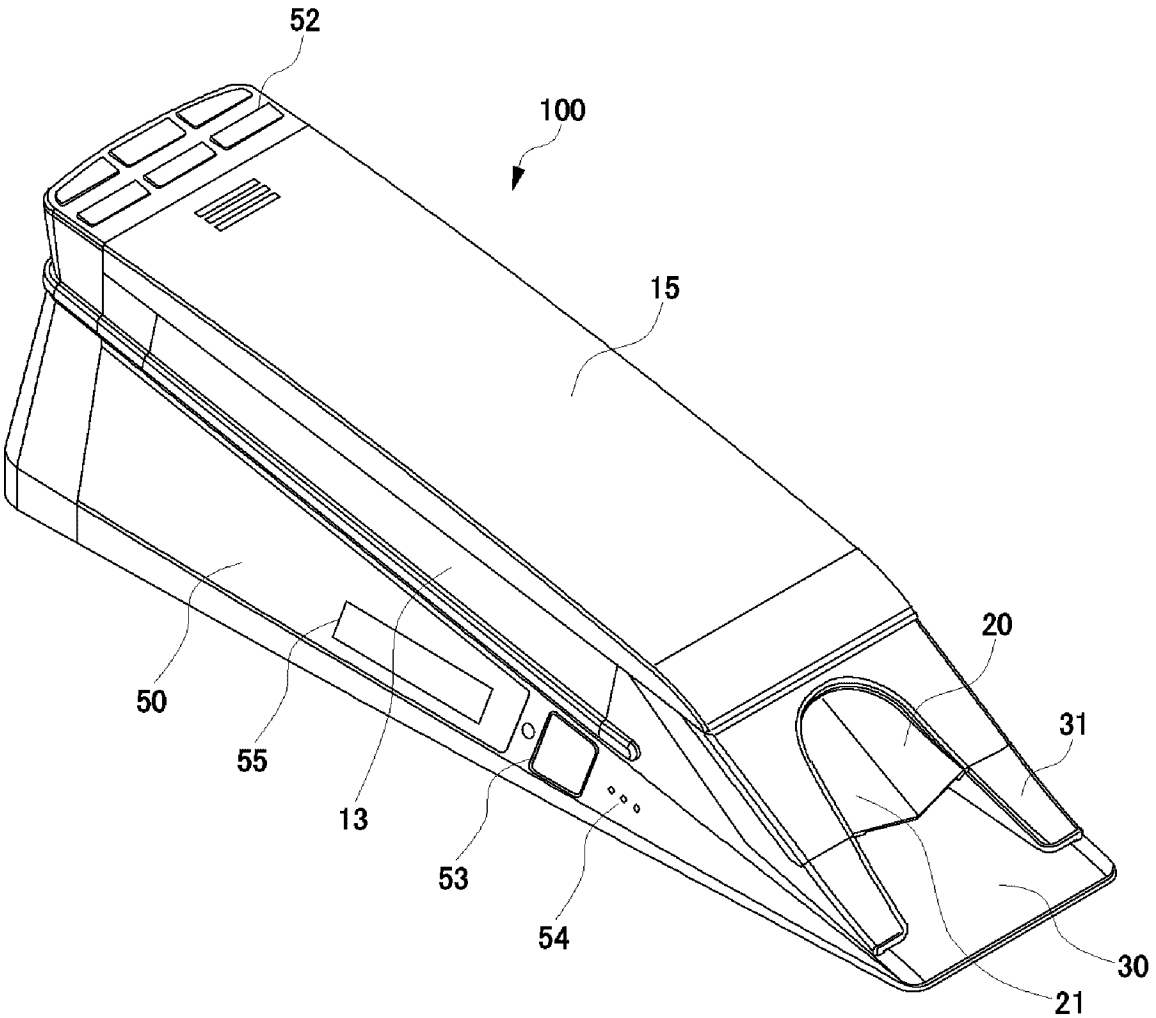
FIG. 7 is a perspective view showing the electronic shoe according to the first embodiment of the present invention.
Figure 8:
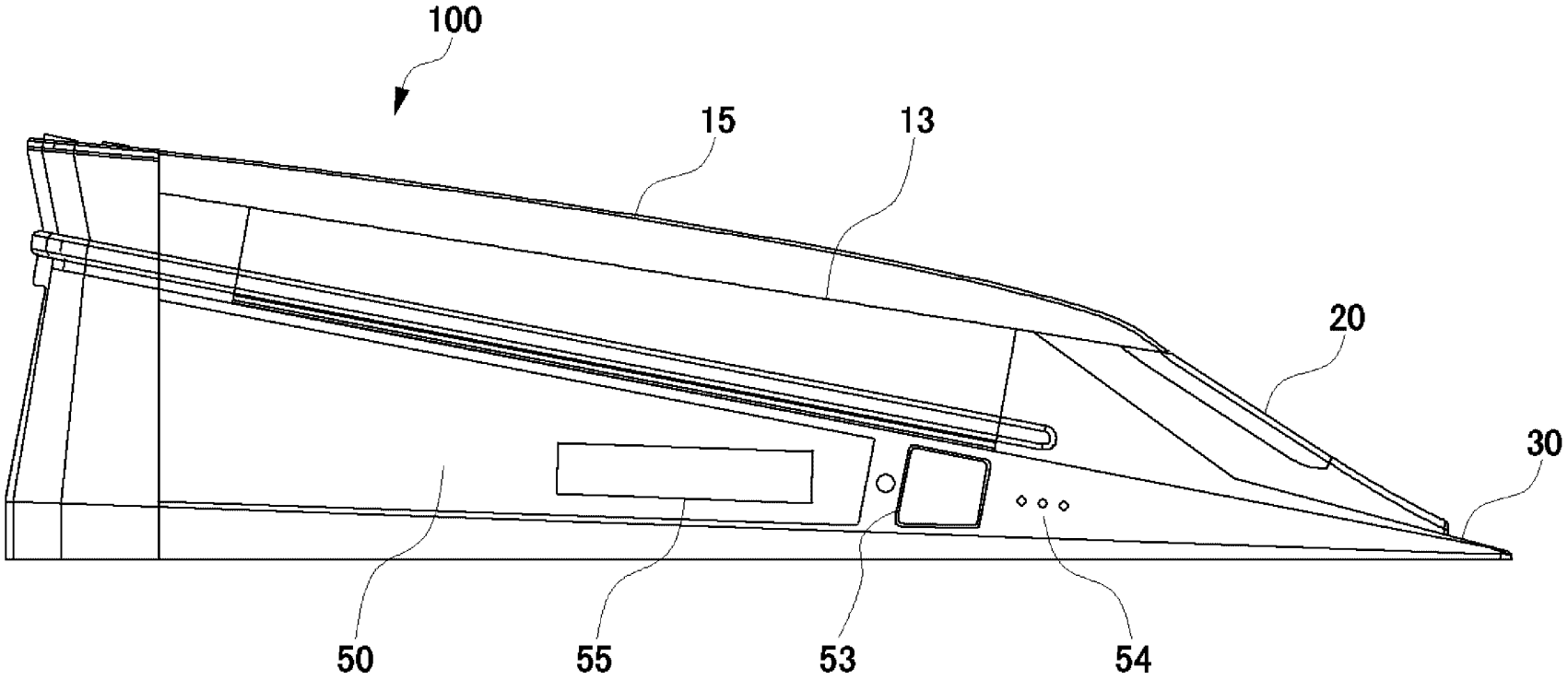
FIG. 8 is a side view showing the electronic shoe according to the first embodiment of the present invention.
Figure 9:
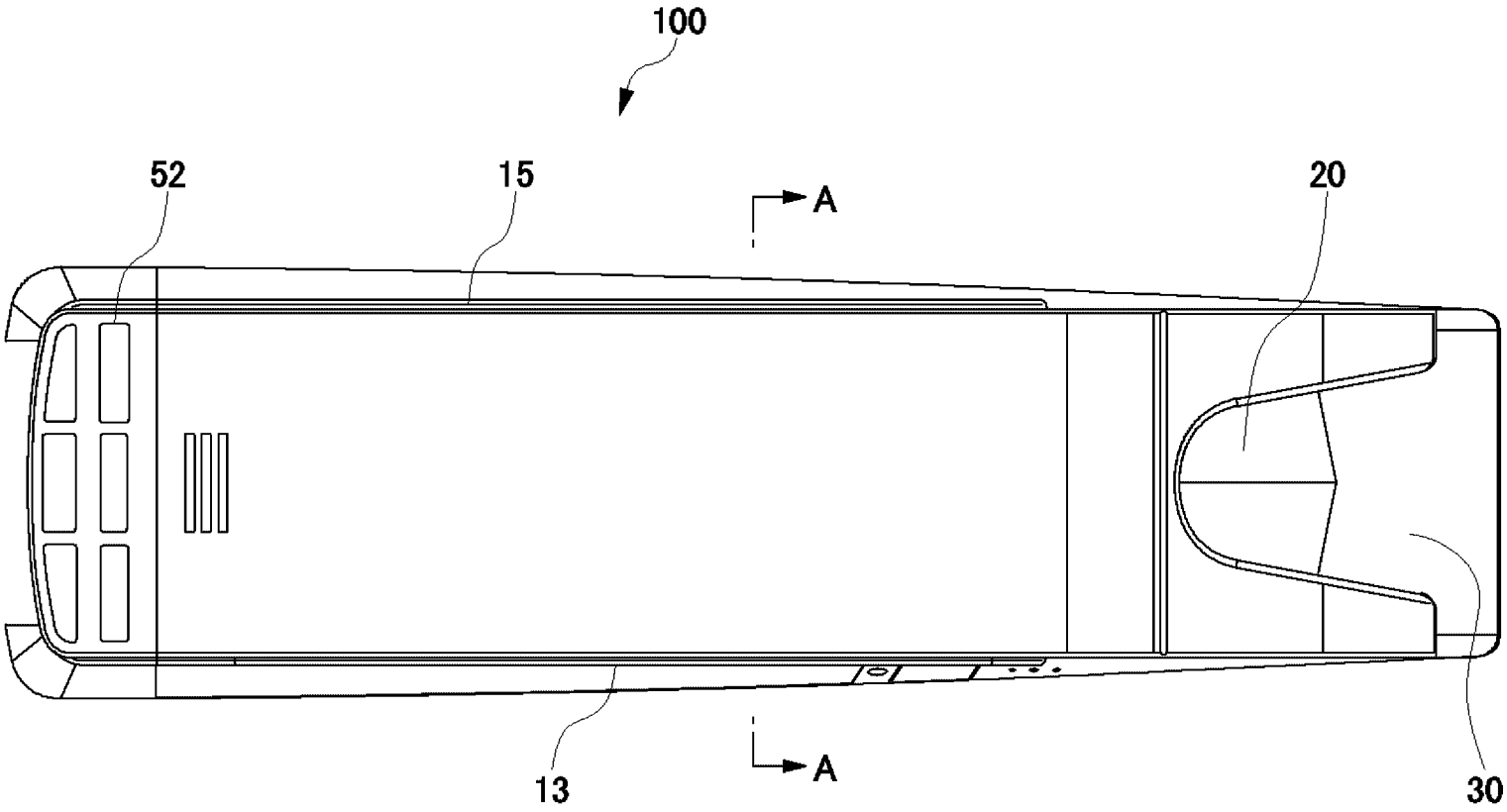
FIG. 9 is a plan view showing the electronic shoe according to the first embodiment of the present invention.

FIG. 7 is a perspective view showing the electronic shoe according to the first embodiment of the present invention, FIG. 8 is a side view showing the electronic shoe according to the first embodiment of the present invention, and FIG. 9 is a plan view showing the electronic shoe according to the first embodiment of the present invention. In the electronic shoe shown in FIGS. 7 to 9, the side surface cover 13 closes the side surface opened portion, and the upper surface cover 15 is installed at the housing portion 10 to close the upper surface opened portion.

In this way, the side surface cover 13 covers the side surface and the upper surface cover 15 covers the upper surface, and so the playing cards housed in the housing portion 10 cannot be seen completely and security is ensured. As is described above, the side surface cover 13 is pivotable between the open position shown in FIG. 1 and the cover position shown in FIG. 7 by rotating around the rotation axis provided in the lower portion. When rotating the side surface cover 13 to be in the cover position, both the right side wall 12 and the side surface cover 13 stand upright and the upper ends thereof become a slide rail of the upper surface cover 15.

In this way, when positioning the side surface cover 13 in the cover position, the upper ends thereof become the slide rail of the upper surface cover 15, and so it is necessary to first stand the side surface cover 13 upright to position it in the cover position where it covers the side surface in order to position the upper surface cover 15 in the cover position, in other words, it forms a structure in which it is impossible to close the upper surface cover 15 without first closing the side surface cover 13.

The upper surface cover 15 slides from the front to the rear on the slide rail to move to the cover position shown in FIG. 7. Whereby, the upper surface cover 15 is installed, by which the side surface cover 13 is also fixed in the cover position.

The electronic shoe 100 may further be provided with sensors (not shown) configured to detect that the side surface cover 13 and the upper surface cover 15 are respectively in the cover position. As those sensors, magnetics or optical sensors may be used. A control device of the electronic shoe 100 outputs an error signal in a case where the sensors do not detect that the side surface cover 13 and upper surface cover 15 are in the cover positions.

The electronic shoe 100 activates a draw restricting pin 38 (described below) to prohibit the draw of the playing cards in the case where the sensors detect that the side surface cover 13 and upper surface cover 15 are not in the cover position.

Figure 10:
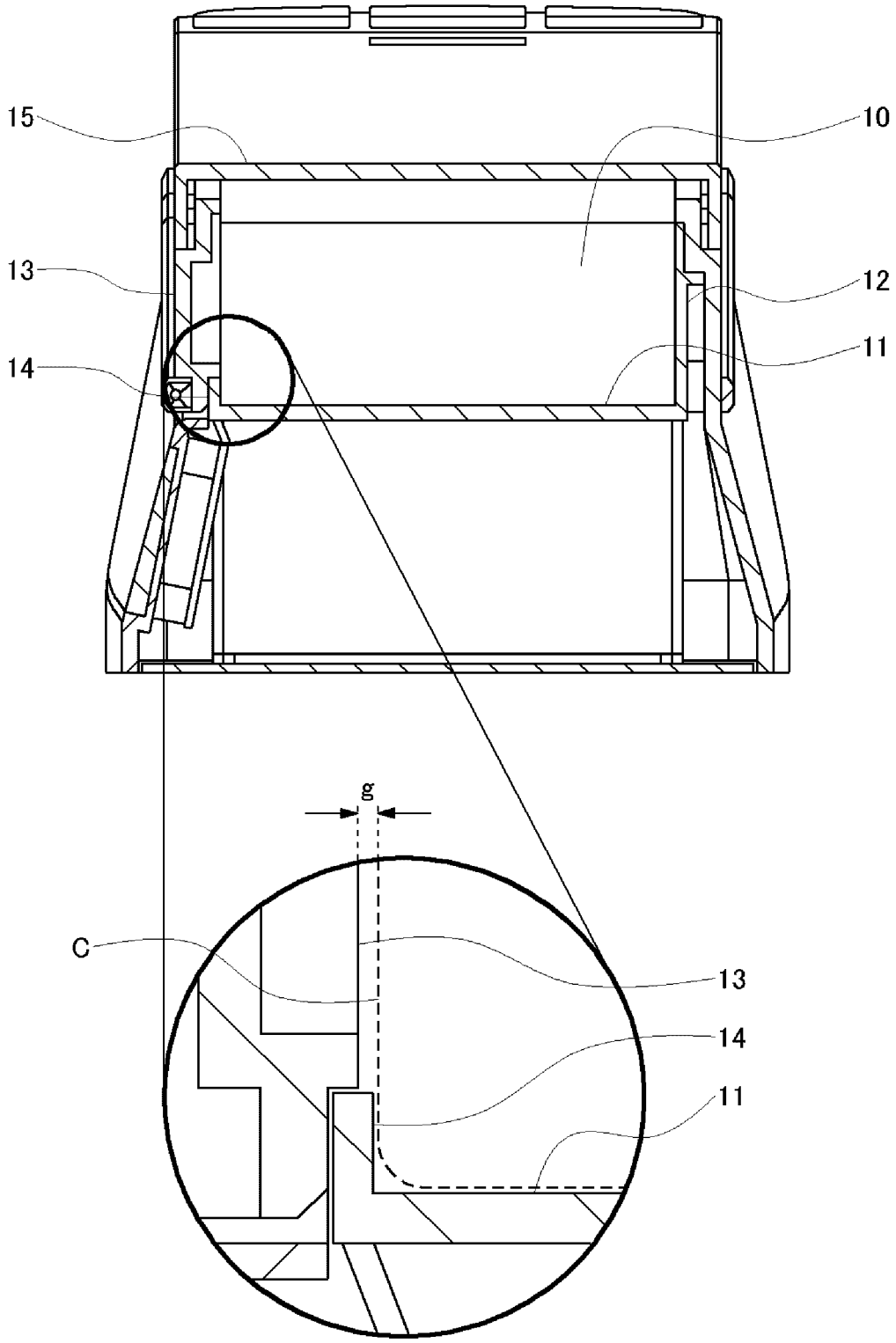
FIG. 10 is an A-A cross-sectional view of FIG. 9.

FIG. 10 is an A-A cross-sectional view of FIG. 9. As shown in FIG. 10, the bottom portion of the housing portion 10 supports the long sides of the playing cards C, and the side wall 14 functions as the stopper and contacts the short sides of the playing cards C to restrict the lateral movements of the playing cards C. The side surface cover 13 is contiguous to and positioned above the side wall 14 formed to be low, but the inner surface of the side surface cover 13 in the cover position is slightly outside of the inner surface of the side wall 14. That is, a gap g is formed between the inner surface of the side wall 14 and the inner surface of the side surface cover 13 in the cover position.

By this structure, it is possible for the plurality of playing cards moving toward the opening portion 20 within the housing portion 10 by being drawn in sequence from the leading playing card to move toward the opening portion 20 without their movements being restricted by the side surface cover 13 protruding from the side wall 14.

Figure 11:
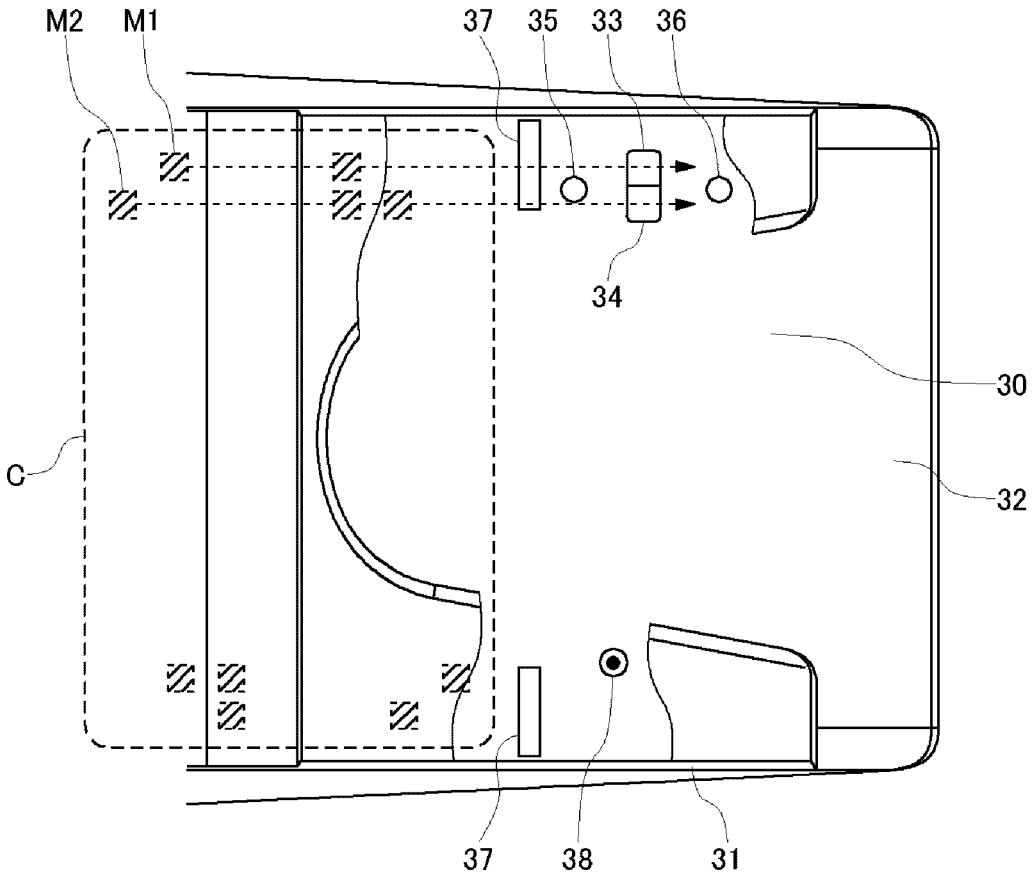
FIG. 11 is a view showing the detail of a draw guide portion according to the first embodiment of the present invention.

FIG. 11 is a view showing the detail of the draw guide portion according to the first embodiment of the present invention. In FIG. 11, the internal structure of the restricting portion 31 is shown in a state where a portion of the restricting portion 31 is removed. The inside of the restricting portion 31 is provided with code reading sensors 33 and 34 for reading a code representing at least a number (rank)

of the shuffled playing card, and card detecting sensors 35 and 36 for detecting that the playing card C is drawn out.

The restricting portion 31 of the draw guide portion 30 may be removable, and the draw guide portion 30 may also be removable from the opening portion 20. Whereby, various types of maintenance become possible.

Figure 12:
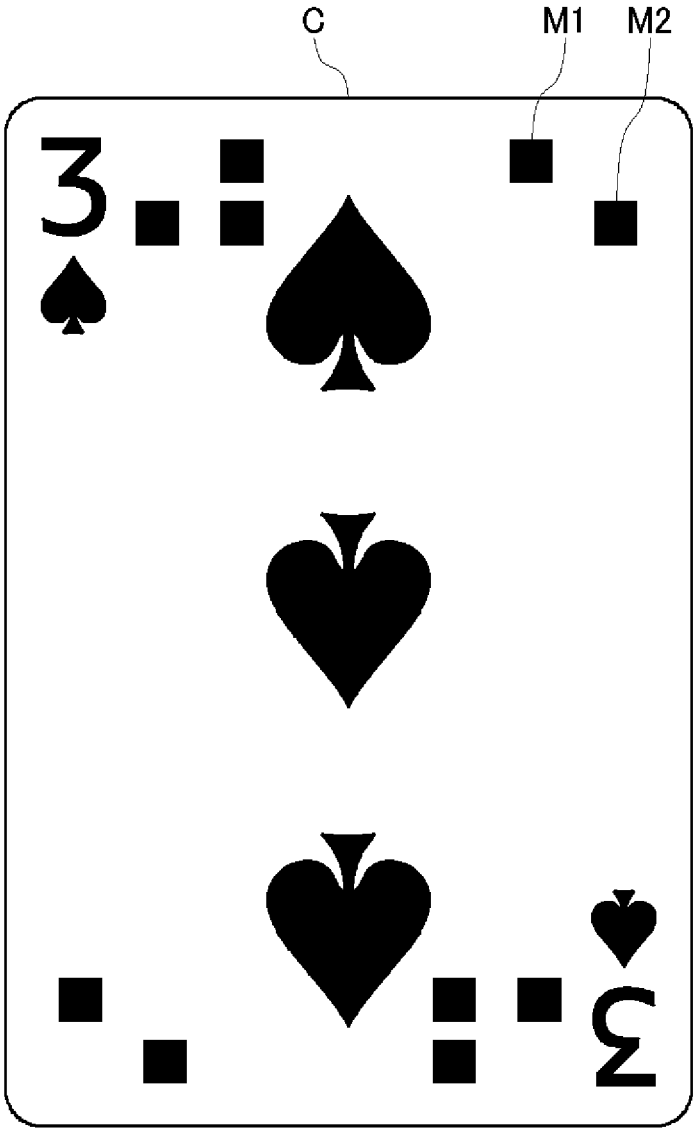
FIG. 12 is a view showing an example of a playing card according to the first embodiment of the present invention.

FIG. 12 is a view showing an example of the playing card according to the first embodiment of the present invention. In the playing card, marks M1 and M2 indicating code information are printed at positions corresponding to the code reading sensors 33 and 34. Both marks M1 and M2 are printed with UV ink which is invisible under natural light.

Each of the code reading sensors 33 and 34 includes a lamp configured to irradiate UV light and a sensor configured to read the mark. The marks M1 and M2 representing the code information are formed in two steps at the end on the side of the short side of the card. As the code information, the two rows of marks M1 and M2 are printed over a plurality of columns. The code information is expressed by combination of presence and absence of the marks M1 and M2.

The code reading sensor 33 reads the mark M1 and the code reading sensor 34 reads the mark M2. The electronic shoe 100 reads the code information based on the combination of the read marks M1 and M2. The code reading sensors 33 and 34 obtain the code information by reading in sequence in the draw-out direction the marks M1 and M2 of the playing card being drawn out. The code information represents the rank of the playing card C. Therefore, the electronic shoe 100 can determine the rank of the playing card C being drawn out.

The electronic shoe 100 determines a game result based on the determined ranks of the cards. The game result may be a player win, banker win, or tie. When the game result indicating button 53 is pressed, the corresponding lamp of the result indicating lamps 52 is turned on according to the determined game result.

The six result indicating lamps 52 correspond to the respective game results of the player win, banker win, tie, player pair, banker pair, and banker 6, respectively. When the game result indicating button 53 is pressed again while the result indicating lamp 52 turns on, the result indicating lamp 52 is turned off to prepare a next game.

The card detecting sensors 35 and 36 are sensors of optical fiber manner configured to detect presence or absence of the playing card C. The card detecting sensors 35 and 36 are provided separately at the front and the rear in the card draw direction. When the card is being drawn out, first the card detecting sensor 35 only turns on, then the card detecting sensors 35 and 36 turn on, then the card detecting sensor 36 only turns on, and finally the card detecting sensors 35 and 36 turn off.

In a case where the card detecting sensors 35 and 36 do not turn on or off in this order, it can be considered that the playing card C is running oppositely. In this case, the electronic shoe 100 determines that it is a card draw error and turns on the corresponding error indicating lamp 51.

The draw guide portion 30 is further provided with a restricting bar 37 configured to prevent the two playing cards from being drawn simultaneously. The restricting bar 37 is formed as a metal part. The restricting bars 37 are provided on both sides of the draw guide portion 30.

Figure 13:
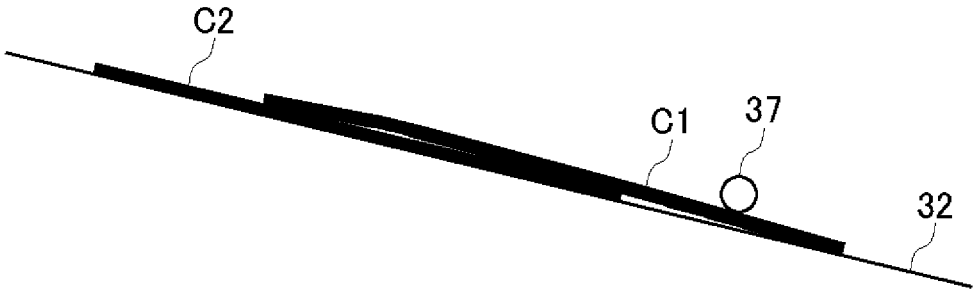
FIG. 13 is a view showing an action of a restricting bar according to the first embodiment of the present invention.

FIG. 13 is a view showing an action of the restricting bar according to the first embodiment of the present invention. A gap through which only one playing card can pass is formed between the restricting bar 37 and the slope portion 32. The restricting bar 37 acts so as to press from the upper side the playing card C being drawn while sliding down the slope portion 32.

In FIG. 13, even when, accompanying that the leading playing card C1 is drawn out, the second playing card C2 is pulled to follow therewith and moves forward, the leading playing card C1 passes between the restricting bar 37 and the slop portion 32 and so the leading playing card C1 is pressed against the slop portion 32, and a second playing card C2 cannot move forward any further, whereby preventing two cards draw.

The draw guide portion 30 is further provided with a draw restricting pin 38. The draw restricting pin 38 is buried under the slop portion 32 in a situation in which it is permitted to draw the playing card C, and protrudes from the slop portion 32 to restrict a draw of the playing card C in a situation in which it is prohibited to draw the playing card C.

In baccarat, the game result is determined by the ranks of the playing cards drawn in sequence. It is determined whether fifth and sixth cards should be drawn based on the ranks of the first to fourth cards. Therefore, the electronic shoe 100 can judge the end of the game based on the ranks of the playing cards C drawn in sequence.

When the game ends, the dealer presses the result indicating button 53 to turn on the result indicating lamp 52, and further presses the result indicating button 53 to turn off the result indicating lamp 52, and the next game starts. After the game ends (the game result is decided), it is prohibited to draw the playing card until the result indicating button 53 is pressed twice and the next game starts.

In such a situation in which the draw is prohibited, the draw restricting pin 38 protrudes to prevent the prohibited draw of the playing card. The draw restricting pin 38 may be buried within the slop portion 32 even in the situation in which the draw is prohibited, and may protrude to prevent the draw of the playing card according that the upstream card detecting sensor 35 detects the card in the situation in which the draw is prohibited. The draw restricting pin 38 further activates when the playing card is overdrawn, when the playing card is transferred backward, when the playing card is stopped in the opening portion 20, and so on.

Whereby, it becomes unnecessary that action that the draw restricting pin 38 protrudes at each time when the game ends and retracts at each time when the game starts, it can be prevented for mechanical noises generated by that the draw restricting pin 38 moves up and down from bothering the dealer and player, and it can be reduced that possibility of malfunction caused by numerous actions.

In the above embodiment, the side surface cover 13 has the structure in which it can perform the rotating movement between the cover position and the open position, but the side surface cover 13 may has a structure in which it can perform a parallel movement between the cover position and the open position. Moreover, the side surface cover 13 may be installable in the cover position and also removable from the cover position.

Figure 14:
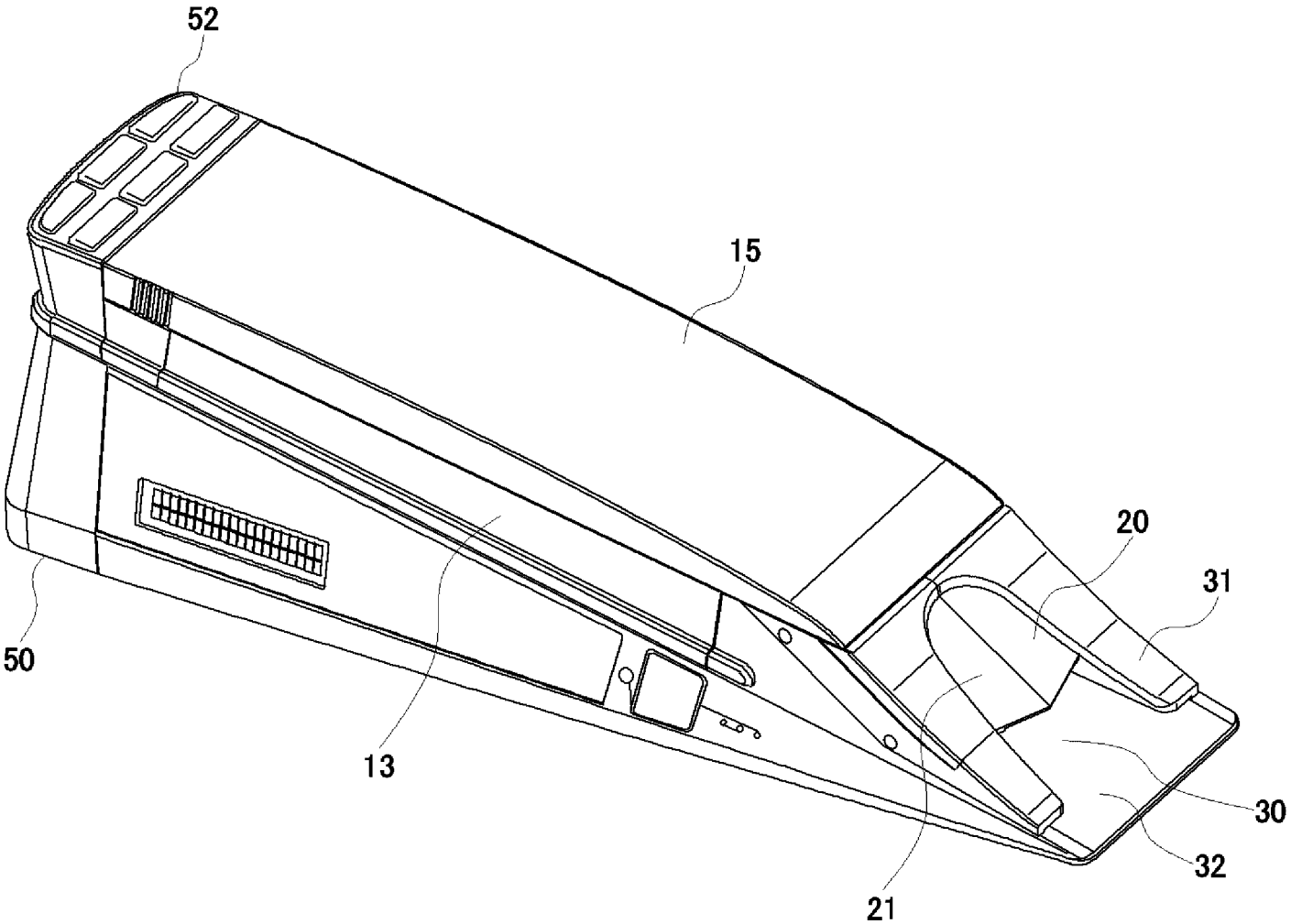
FIG. 14 is a perspective view showing an electronic shoe according to a second embodiment of the present invention.

An electronic shoe according to a second embodiment of the present invention is described below. In the electronic shoe according to the second embodiment, the same reference mark is given to the same structure as that of the electronic shoe according to the first embodiment, and explanations thereof are omitted appropriately. FIG. 14 is a perspective view showing the electronic shoe according to the second embodiment of the present invention. In FIG. 14, the electronic shoe in a state in which an upper surface cover is installed is shown. The basic structure of the electronic shoe 101 according to this embodiment is the same as that of the electronic shoe 100 according to the first embodiment. The electronic shoe 101 includes a housing portion 10, an opening portion 20, a draw guide portion 30, a weight 40 and a main body 50.

Figure 15:
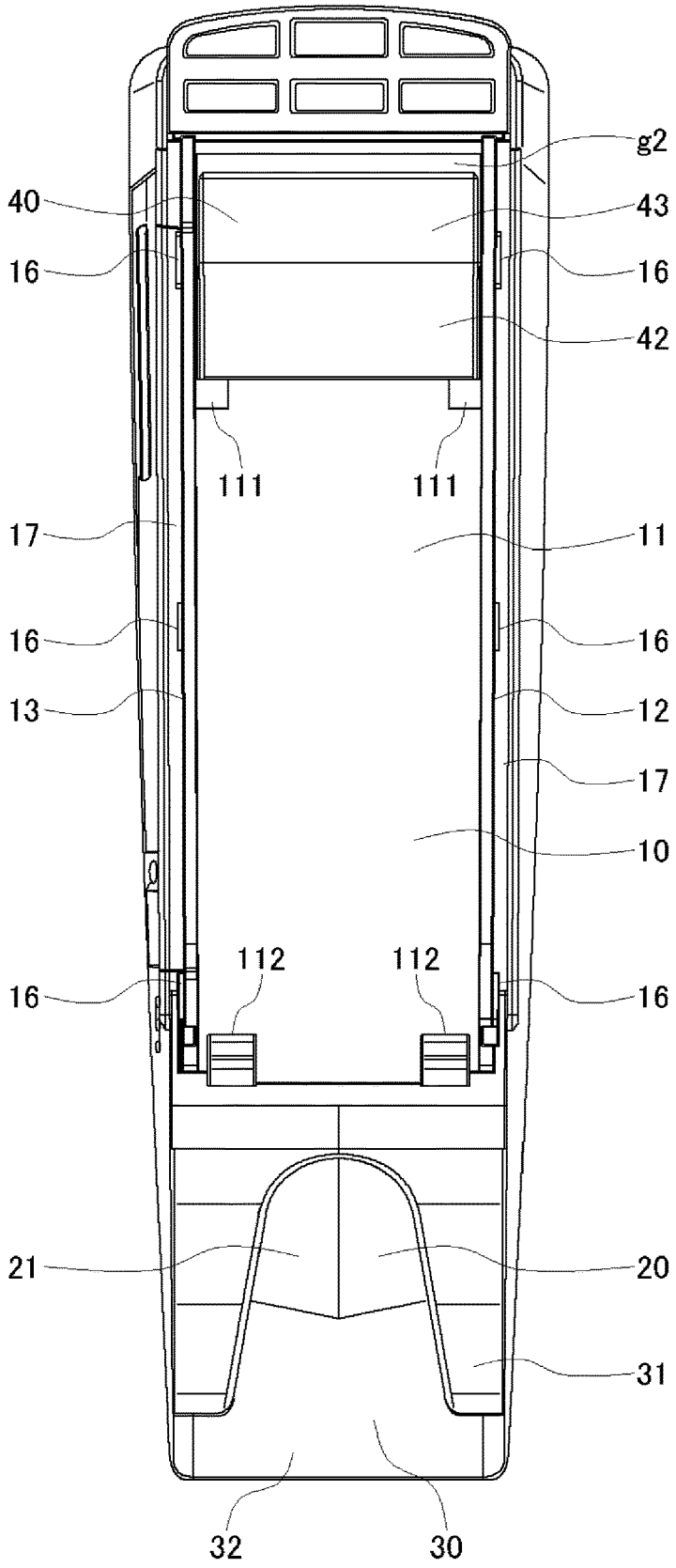
FIG. 15 is a plan view showing the electronic shoe according to the second embodiment of the present invention.
Figure 16:
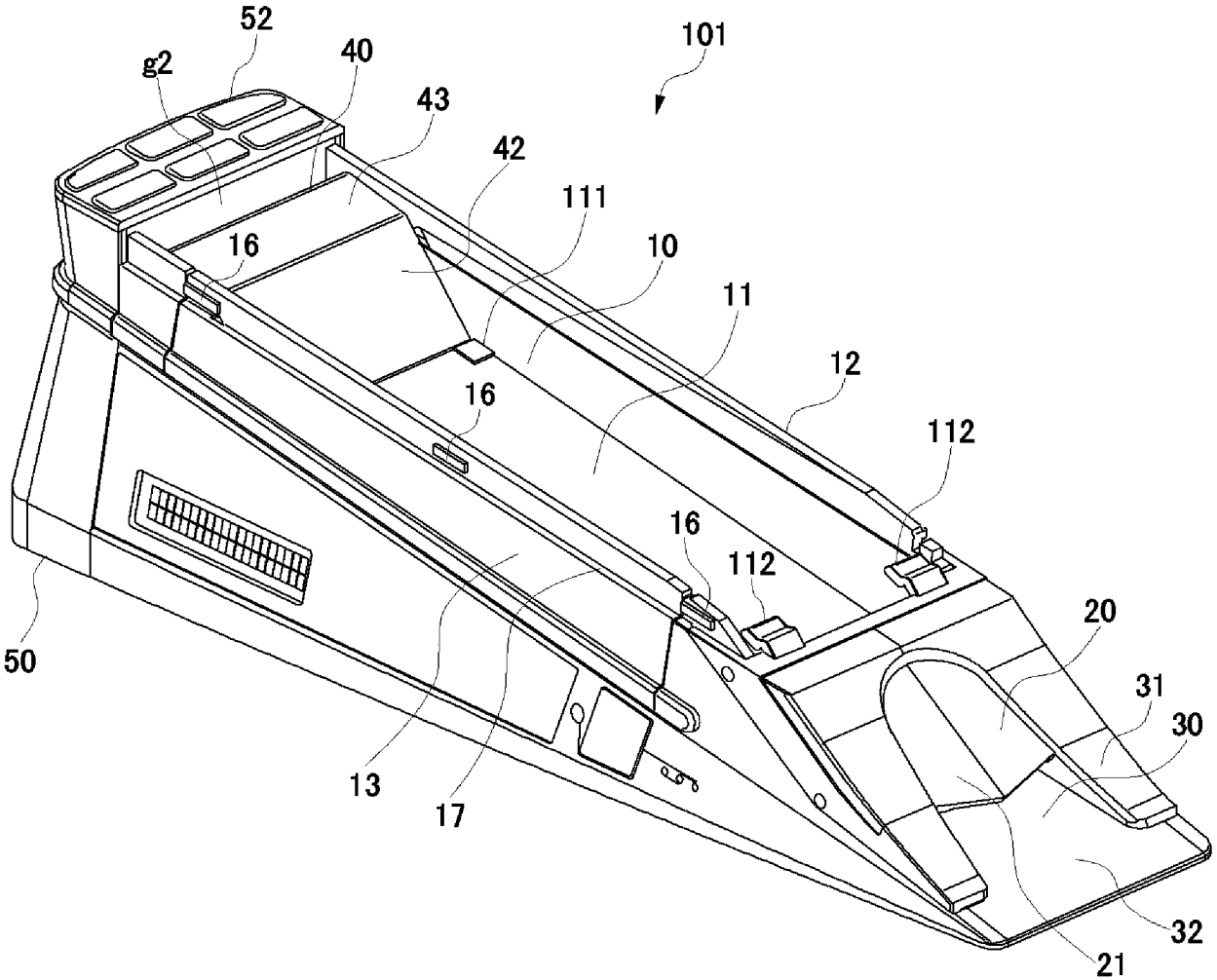
FIG. 16 is a perspective view showing the electronic shoe according to the second embodiment of the present invention.

FIG. 15 is a plan view showing the electronic shoe according to the second embodiment of the present invention, and FIG. 16 is a perspective view showing the electronic shoe according to the second embodiment of the present invention. In FIGS. 15 and 16, the electronic shoe in a state in which the upper surface cover removed is shown. A bottom surface 11 of the electronic shoe 101 is provided with weight stoppers 111 at a position of about ¼ of the total length of the housing portion 10 from the rear end of the housing portion 10. The weight stoppers 111 are provided one by one on the right and the left. The left and right weight stoppers 111 are formed contiguously from side walls 12 and 14, respectively. The height of the weight stopper 111 is about 1 mm.

When the weight 40 is placed at the rear end of the housing portion 10 in the state in which the upper surface cover 15 is removed, the front end of a slope surface 42 contacts the weight stopper 111, and so it is restricted to fall down on the slope surface of the bottom surface 11 and remains on the rear end side (an upper portion holding position) of the housing portion 10. The dealer can collect the remaining playing cards and load new playing cards in this state, that is, the state in which the weight 40 does not press the playing cards forward.

Each of the outside of the upper end of the side surface cover 13 and the outside of the upper end of the side wall 12 of the housing portion 10 are provided with engaging protrusions 16 protruding outwardly. The engaging protrusions 16 are provided above a slide rail 17, and engaging protrusions 154 of the upper surface cover 15 described below are inserted between the slide rail 17 and these engaging protrusions 16, and so the upper surface cover 15 is installed and fixed to the housing portion 10.

The distance from the weight stopper 111 to the rear end of the housing portion 10 is designed so as to secure a gap g2 to the extent that a finger can be inserted between the rear end of the upper surface of the weight 40 and the rear end of the housing portion 10 in the state in which the front end of the slope surface 42 of the weight 40 is restricted from descending the slope surface of the bottom surface 11 by the weight stopper 111. By securing this gap g2, the dealer can pick up the weight 40 with the finger and position it in the upper portion holding position.

Figure 17:
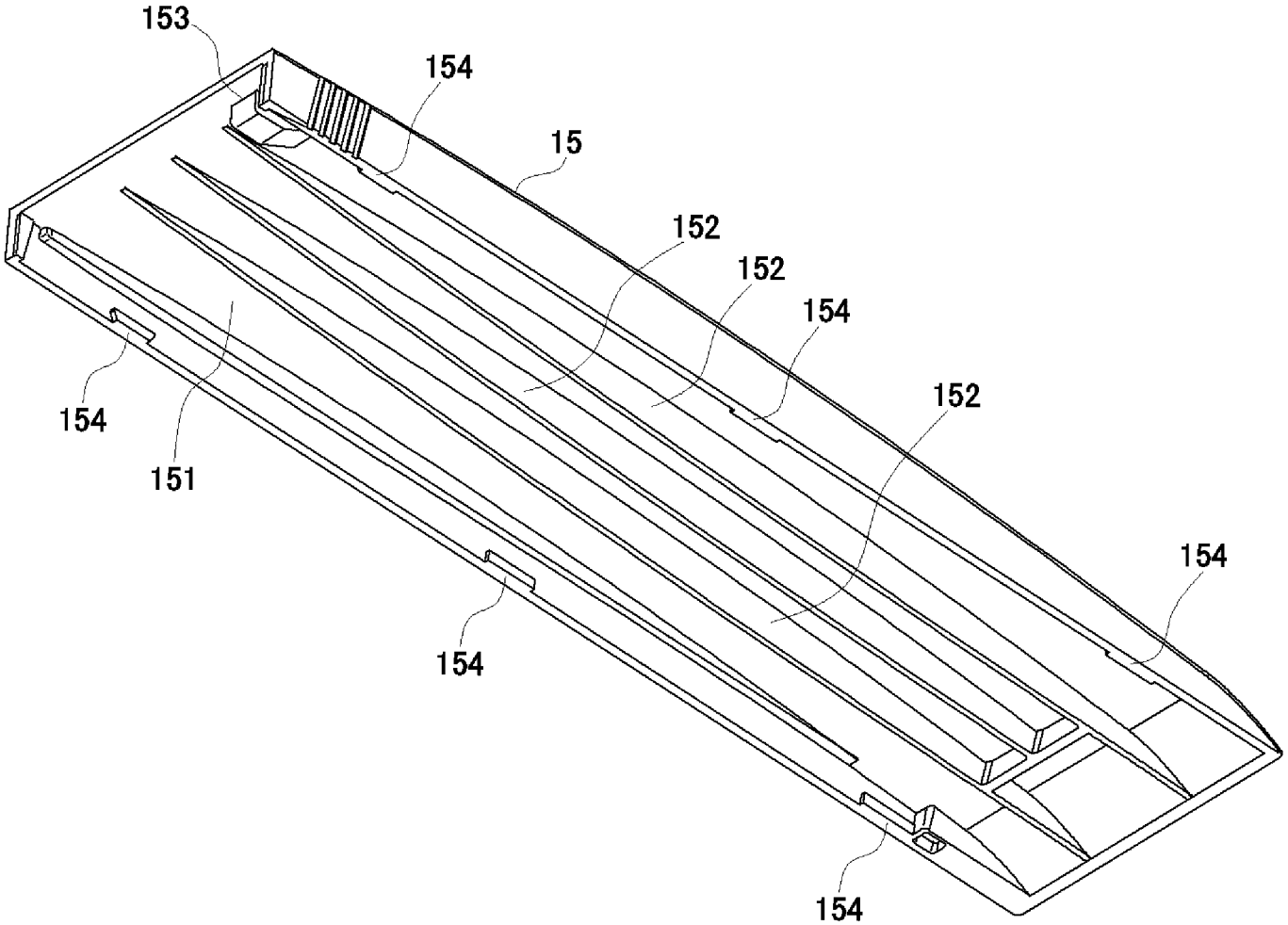
FIG. 17 is a perspective view showing an upper surface cover according to the second embodiment of the present invention.

FIG. 17 is a perspective view showing the upper surface cover according to the second embodiment of the present invention. A plurality of ribs 152 are formed in the longitudinal direction on an inner surface 151 of the upper surface cover 15. The rib 152 increases the rigidity of the upper surface cover 15, and, in addition, performs a function for restraining the playing cards housed in the electronic shoe 101 from rising too much due to the action of the weight 40 when it is installed to the electronic shoe 101. That is, the rib 152 contact the upper surfaces (upper long sides) of the playing cards housed in the housing portion 10 and pressed forward by the weight when the upper surface cover 15 is installed to the electronic shoe 101.

Moreover, the rear end of the inner surface 151 is provided with a push-down protrusion 153. In the present embodiment, the push-down protrusion 153 is provided at a position closer to one side of the width direction, but the push-down protrusion 153 may be provided in the center of the width direction, a plurality of push-down protrusions 153 may be provided in the width direction, and it may be provided over the whole of the width direction.

Furthermore, longitudinal walls are formed on the long sides on both sides of the upper surface cover 15, and the lower ends of the longitudinal walls are provided with a plurality of engaging protrusions 154 toward the inner side of the width direction. These engaging protrusions 154 are provided in positions where these engage with the engaging protrusions 16 provided in the housing portion 10 when the upper surface cover 15 is positioned in a position where it completely covers the housing portion 10 (that is, the position of the upper surface cover 15 in FIG. 14, hereinafter referred to as "cover position").

Figure 18:
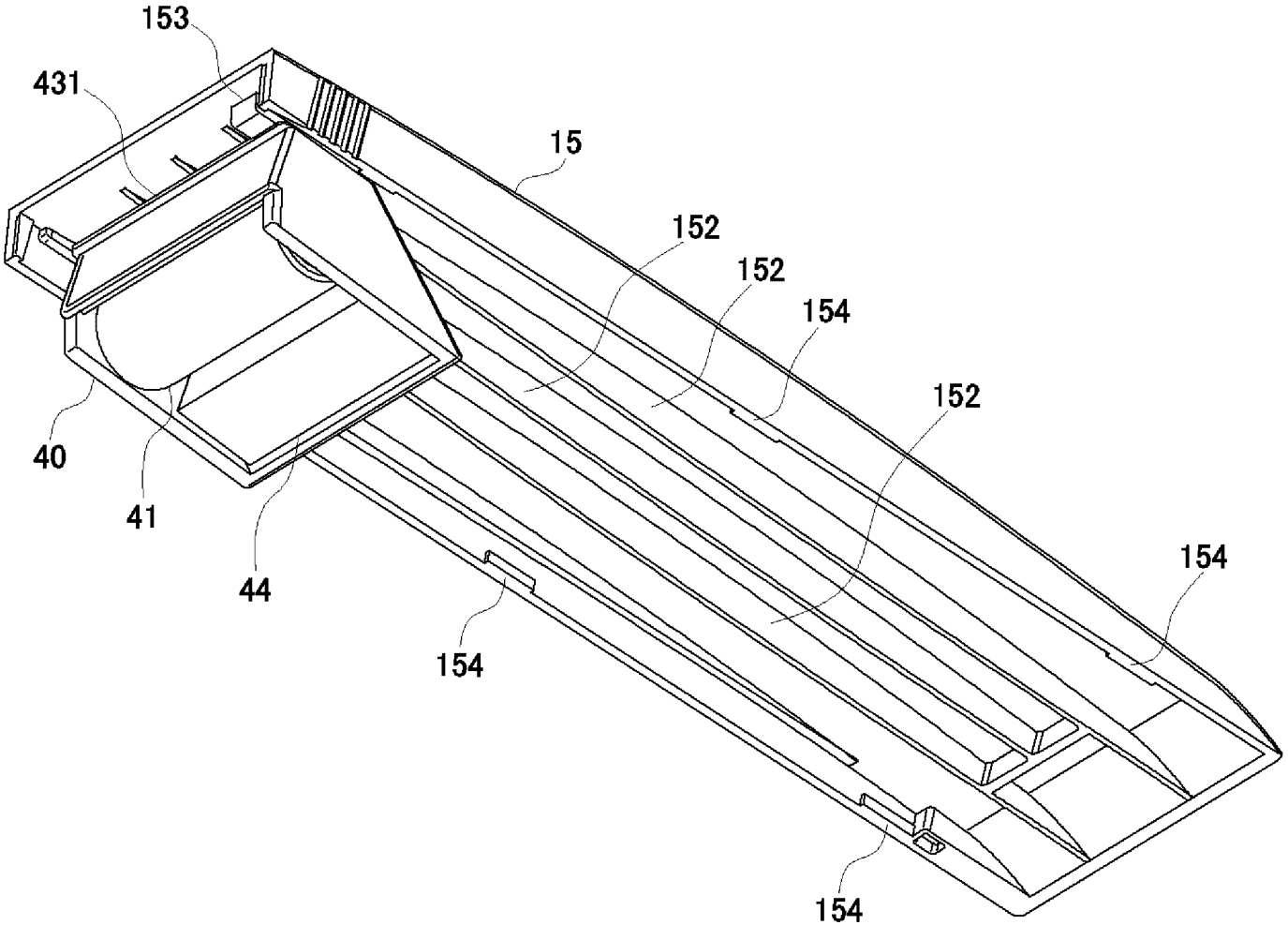
FIG. 18 is a perspective view showing a relationship between the upper surface cover and a weight according to the second embodiment of the present invention.

FIG. 18 is a perspective view showing a relationship between the upper surface cover and the weight according to the second embodiment of the present invention. FIG. 18 shows a positional relationship between the weight 40 and the upper surface cover 15 when the weight 40 is in the upper portion holding position and the upper surface cover 15 is about to be installed in the cover position. At this time, the push-down protrusion 153 contacts with the rear end portion of the upper surface 43 of the weight 40.

The rear end portion of the upper surface 43 of the weight 40 includes an eave portion 431 formed to extend from the upper surface 43. The dealer can grasp the weight 40 or lift the rear end side thereof by hooking the fingertip on the eave portion 431.

Figure 19:
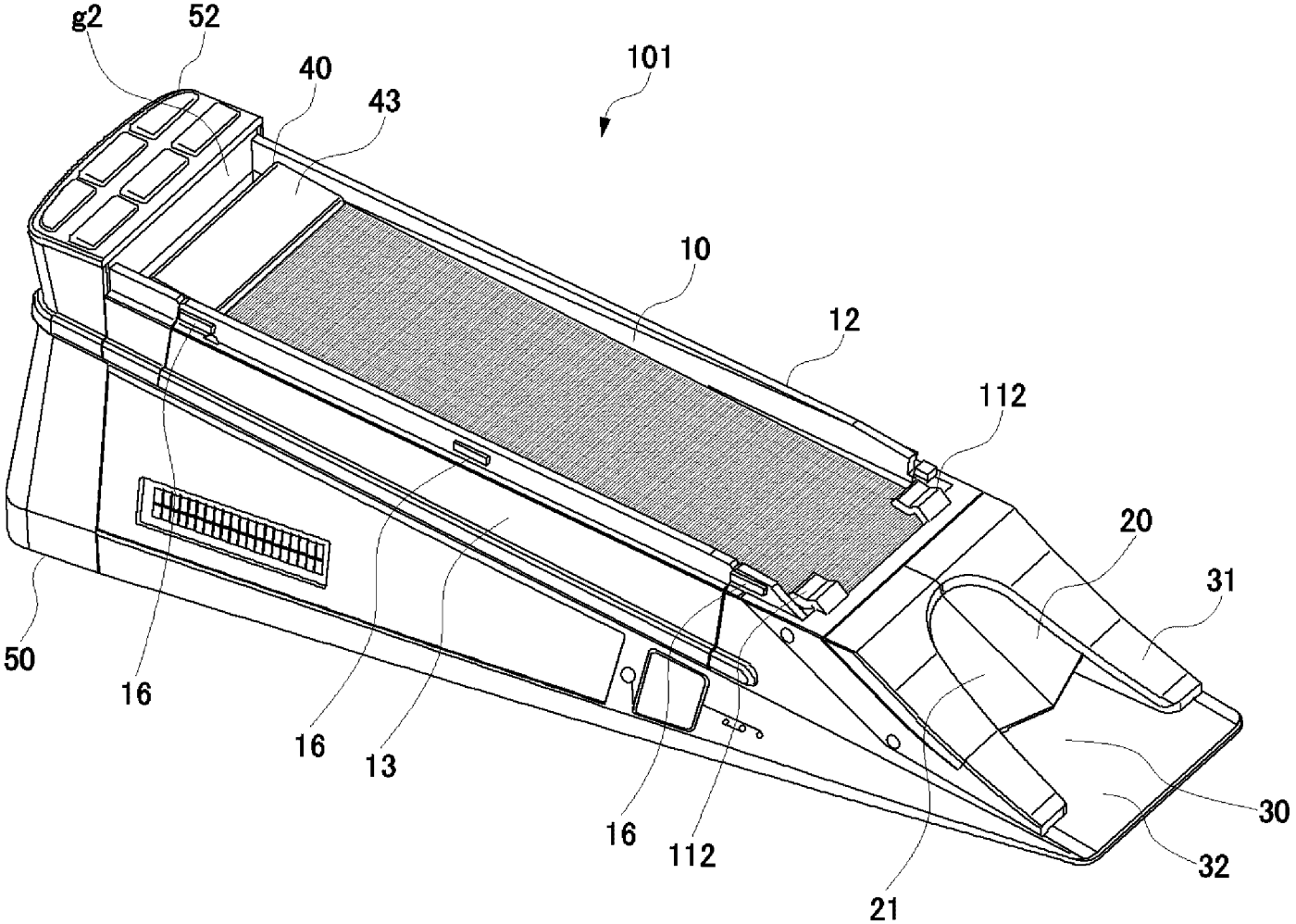
FIG. 19 is a perspective view showing the electronic shoe according to the second embodiment of the present invention.

FIG. 19 is a perspective view showing the electronic shoe according to the second embodiment of the present invention. FIG. 19 shows a state in which new playing cards are loaded in a state in which the weight 40 is held in the upper portion holding position. The dealer houses the playing cards in a state in which these lay such that the plurality of playing cards is loaded in the whole space in front of the weight 40 held in the upper portion holding position in the housing portion 10. Whereby, the upper surfaces of the plurality of playing cards are positioned in relatively low positions and do not interfere with the installation of the upper surface cover 15 to the housing portion 10.

Figure 20A:
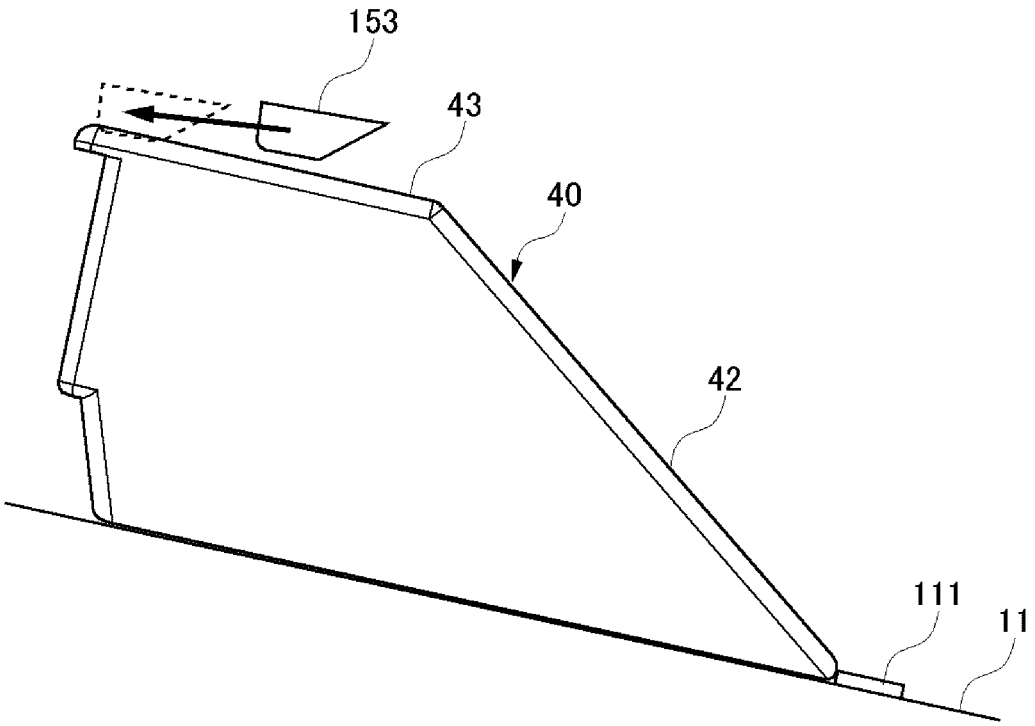
FIG. 20A is a view explaining an action of a push-down protrusion according to the second embodiment of the present invention.
Figure 20B:
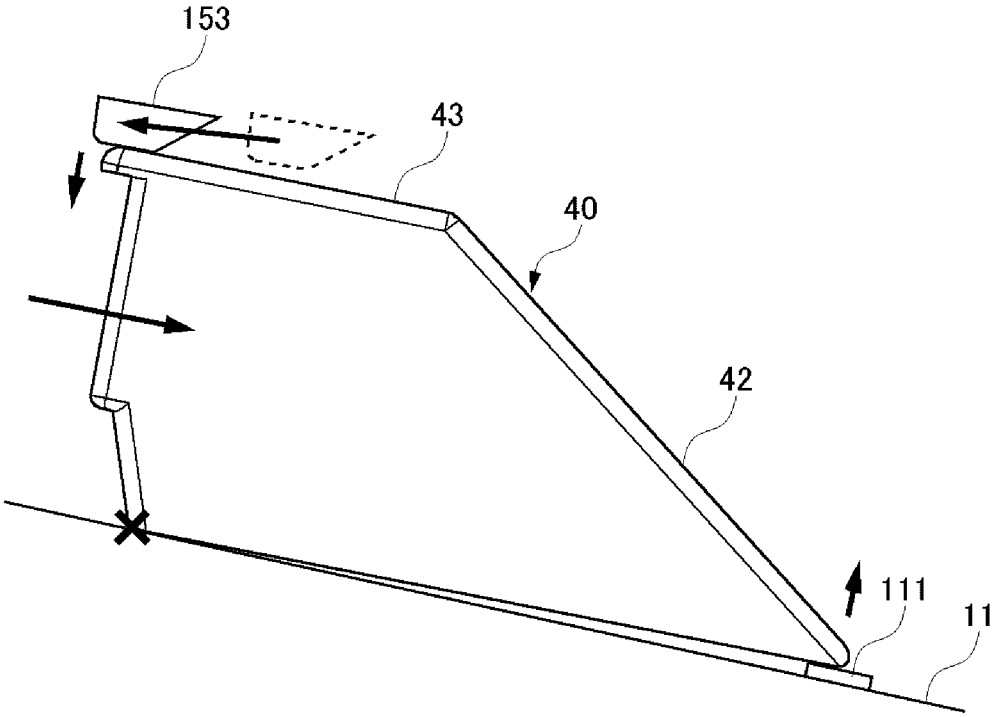
FIG. 20B is a view explaining the action of the push-down protrusion according to the second embodiment of the present invention.

FIGS. 20A and 20B are views explaining the action of the push-down protrusion according to the second embodiment of the present invention. FIGS. 20A and 20B show a position and a movement of the push-down protrusion 153 when the upper surface cover 15 slides from the front to the rear on the slide rail 17. When the upper surface cover 15 is positioned at the more front than the cover position, the push-down protrusion 153 is positioned in a position apart from the upper surface 43 of the weight 40, as shown in FIG. 20A. When the upper surface cover 15 slides from the front to reach the cover position, the push-down protrusion 153 pushes down the rear end of the upper surface 43 of the weight 40.

By the action of the push-down protrusion 153, the front end of the weight 40 is lifted up using the rear end of the bottom surface as a fulcrum (X mark in FIG. 20B) by the principle of leverage. Whereby, the front edge of the weight 40 crosses over the weight stopper 111. In this state, a movement of the weight 40 is not restricted by the weight stopper 111, and so the weight 40 slides to descend on the sloping bottom surface 11 by its own weight. At this time, a weight portion 44 of the weight 40 (referred to FIG. 18) is arranged in the front of the weight 40 (below the slope surface 42), and so the weight 40 slides downward smoothly crossing over the weight stopper 111.

The diameter of both end portions corresponding to the weight stopper 111 in the roller 41 may be designed to be smaller corresponding to the thickness of the weight stopper 111. Whereby, it is not necessary for the roller 41 to cross over the weight stopper 111, the roller 41 is not stopped by the weight stopper 111, and it becomes possible that the smooth movement on the weight stopper 111.

In this way, by the action of sliding the upper surface cover 15 to the cover position, it is released that the state in which the weight 40 held in the upper portion holding position by the weight stopper 111, and the weight 40 slides downward to press the last playing card toward the front. That is, the holding of the weight 40 is released according that the upper surface cover 15 comes to the cover position. Whereby, the plurality of playing cards rises up at the angle of the slope surface 42 of the weight 40, but this rising of the playing cards is restrained by the rib 152 of the installed upper surface cover 15.

Previously, a weight is slid forward by its own weight in a state in which an upper surface cover is opened, and, in a state in which a plurality of playing cards rises up along a slope surface of the weight thereby, the upper surface cover is installed. In this case, the upper surface cover pushes down the upper surfaces of the standing-up plurality of playing cards against the forward force caused by weight's own weight, and thereby, the upper surface cover is installed to the housing portion. In this case, it must be adapted that a manner that the upper surface cover is installed from the upper side toward the lower side with respect to the housing portion and fixed by magnets and the like, and, when the plurality of playing cards raises up by the weight's own weight, the upper surface cover may be lifted up thereby.

In contrast, in the present embodiment, it is adapted that a structure in which the upper surface cover 15 is installed to the housing portion 10 by sliding it, and the upper surface cover 15 is configured to be installed to the housing portion 10 by engaging the engaging protrusions 16 (referring to FIG. 16) provided on the slide rail 17 of the housing portion 10 with the engaging protrusions 154 of the upper surface cover 15 by sliding it with respect to the housing portion 10, and so the upper surface cover 15 is prevented from lifting up. Moreover, the movement restriction of the weight 40 by the weight stopper 111 is released to slide it forward by the action of sliding the upper surface cover 15 in such a manner, and so it is possible to press the last of the plurality of playing cards toward the front at the same time when the upper surface cover 15 is installed in the cover position or immediately after the upper surface cover 15 is installed in the cover position, and to certainly restrain the rise of the plurality of playing cards due to the weight's own weight 40 by the ribs 152 of the upper surface cover 15.

Figure 21:
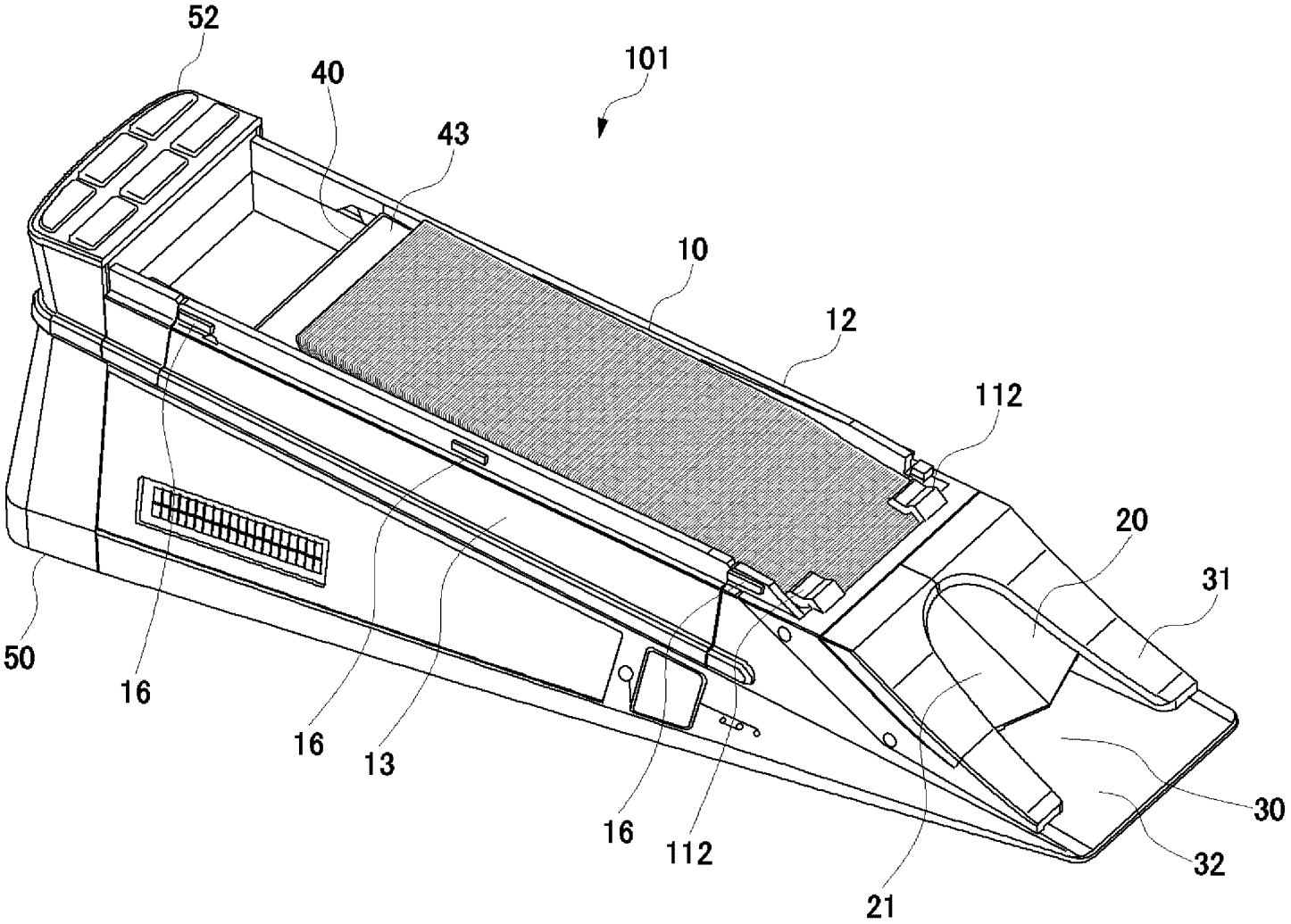
FIG. 21 is a perspective view showing the electronic shoe according to the second embodiment of the present invention.

FIG. 21 is a perspective view showing the electronic shoe according to the second embodiment of the present invention. FIG. 21 shows a state in which the weight 40 crosses over the weight stopper 111 and presses the plurality of playing cards forward from the last. As mentioned above, such a state is realized by installing the upper surface cover 15, but FIG. 21 shows the state in which the weight 40 pushes the plurality of playing cards forward in a state in which the upper surface cover 15 is removed.

Figure 22:
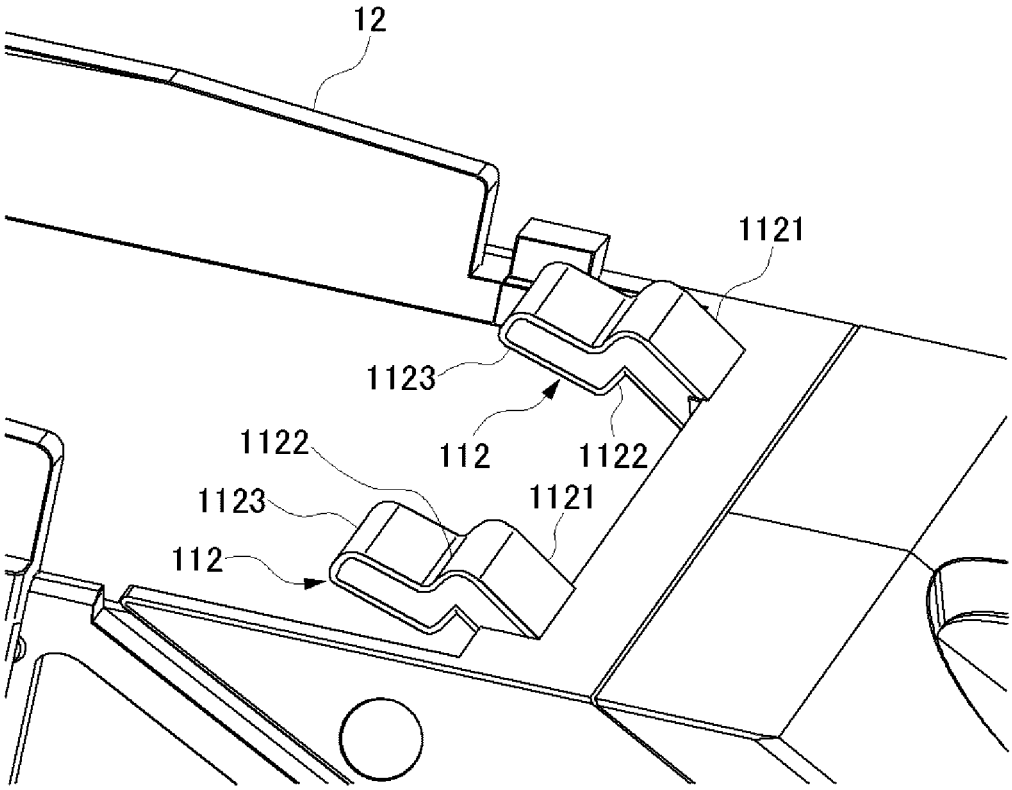
FIG. 22 is a perspective view enlarged showing the front portion of the electronic shoe according to the second embodiment of the present invention.

FIG. 22 is a perspective view enlarged showing the front portion of the electronic shoe according to the second embodiment of the present invention. FIG. 22 shows in a state in which some parts on the left side are removed to expose backflow stoppers 112. The front end of the housing portion 10 is provided with two left and light backflow stoppers 112 so as to cover the upper surface opened portion. The backflow stopper 112 restrict that the leading playing card housed in the housing portion 10 flows back due to an operation of the dealer.

The backflow stopper 112 includes a base end portion 1121 extending rearward and upward in a direction substantially parallel to plane directions of the housed playing cards, a backflow restricting portion 1122 contiguous from the tip end of the base end portion 1121 and bent downward at a substantially right angle, and a restraining portion 1123 contiguous from the tip end of the backflow restricting portion 1122 and extending backward so as to be along the upper surface of the housed playing cards.

Figure 23A:
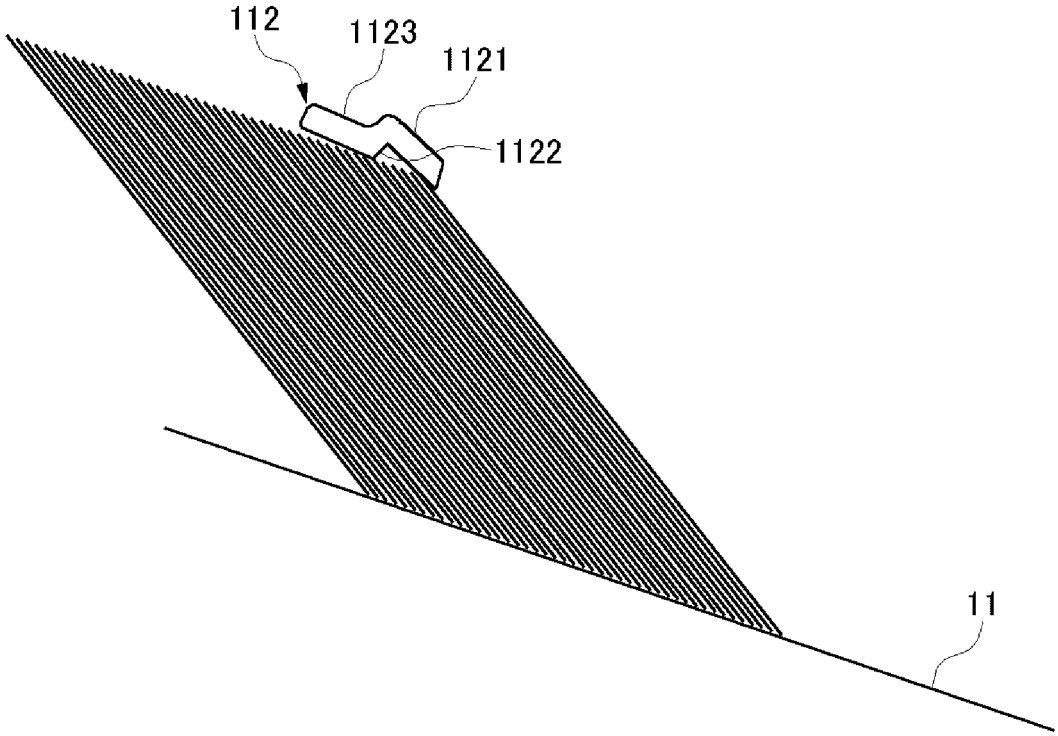
FIG. 23A is a view explaining an action of a backflow stopper according to the second embodiment of the present invention.
Figure 23B:
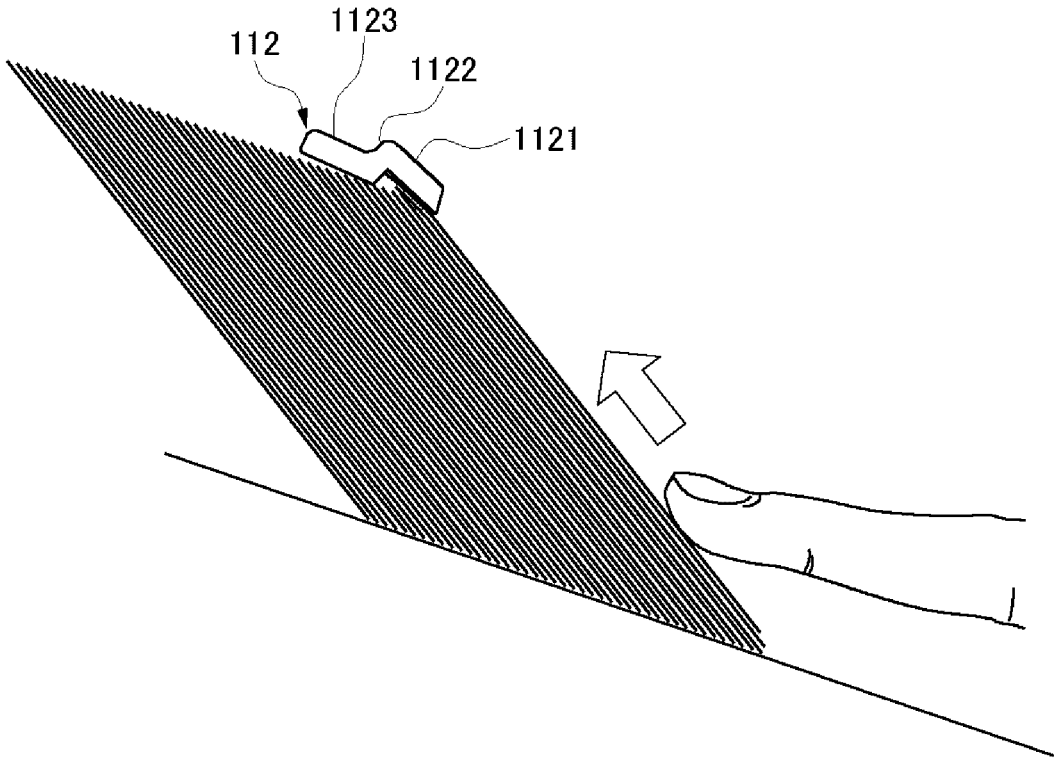
FIG. 23B is a view explaining the action of the backflow stopper according to the second embodiment of the present invention.

FIGS. 23A and 23B are views explaining an action of the backflow stopper according to the second embodiment of the present invention. FIG. 23A shows a normal state. In FIG. 23A, the bottom edge of each playing card contacts with the bottom surface 11. As shown in FIG. 23B, when the leading (front end) playing card is pushed up with the finger, the upper end of the leading playing card rises along the base end portion 1121 of the backflow stopper 112 and hits against the backflow restricting portion 1122. Whereby, it is prevented that the backflow of the leading playing card.

As shown in FIG. 23B, a slight rise (backflow) is allowed to the extent that the upper end of the leading playing card hits the backflow restricting portion 1122, but the leading playing card cannot be moved to the extent that the second playing card can be drawn out.

Figure 24A:
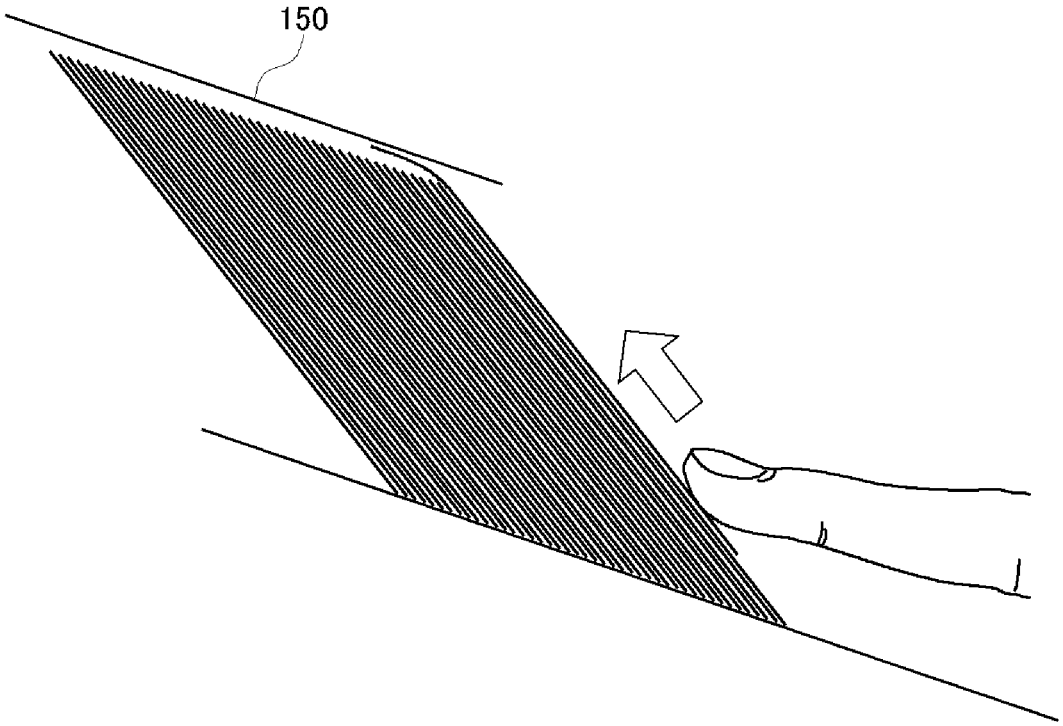
FIG. 24A is a view explaining a backflow in a prior electronic shoe.
Figure 24B:
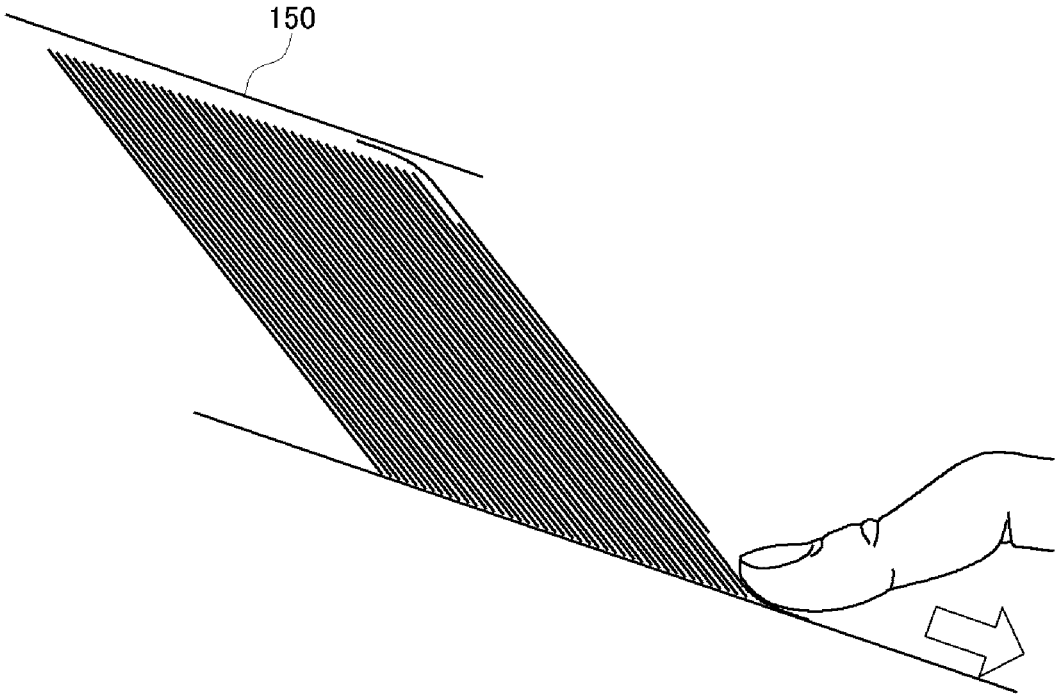
FIG. 24B is a view explaining the backflow in the prior electronic shoe.
Figure 25:
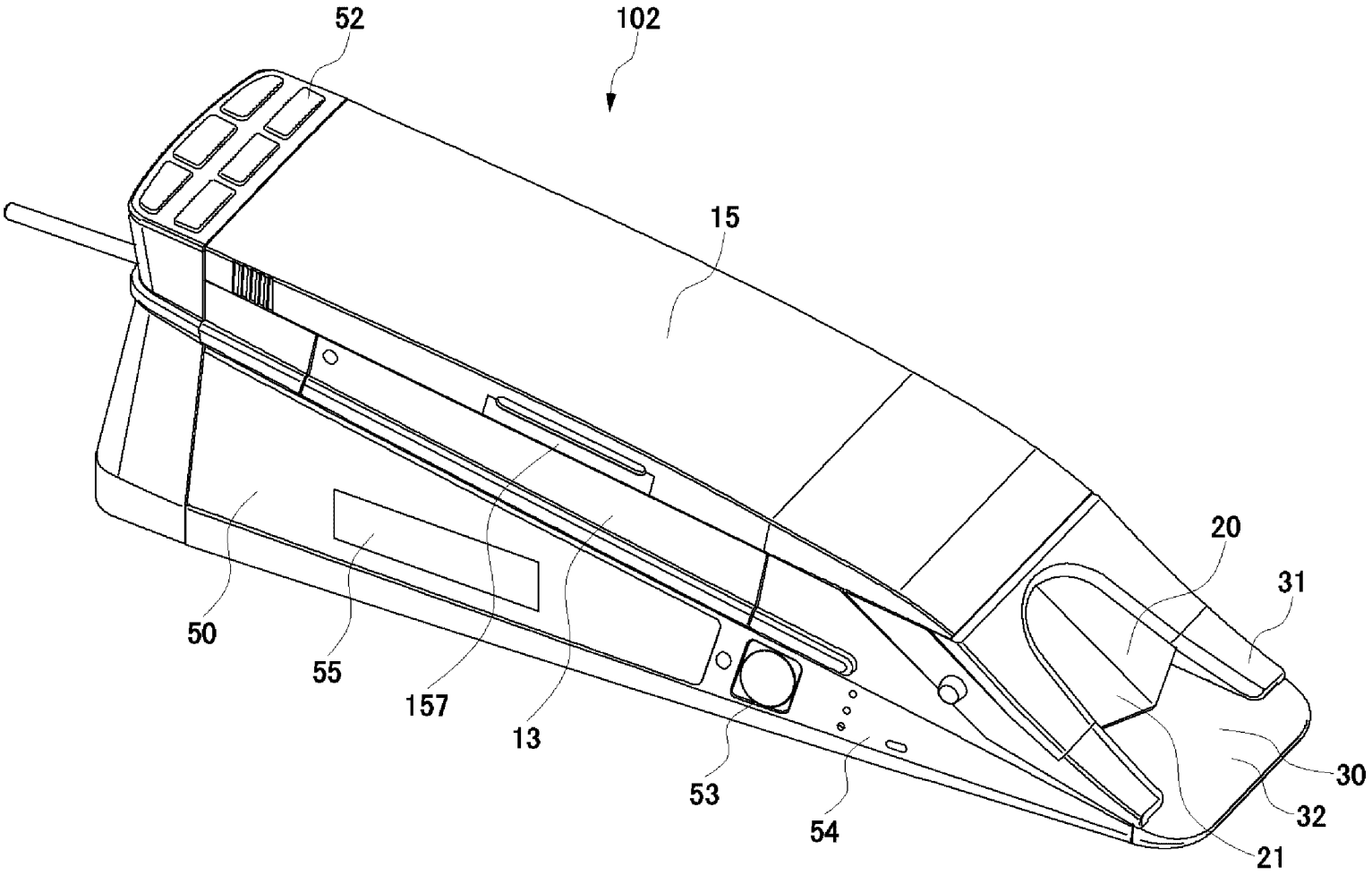
FIG. 25 is a perspective view showing an electronic shoe according to a third embodiment of the present invention.
Figure 26:
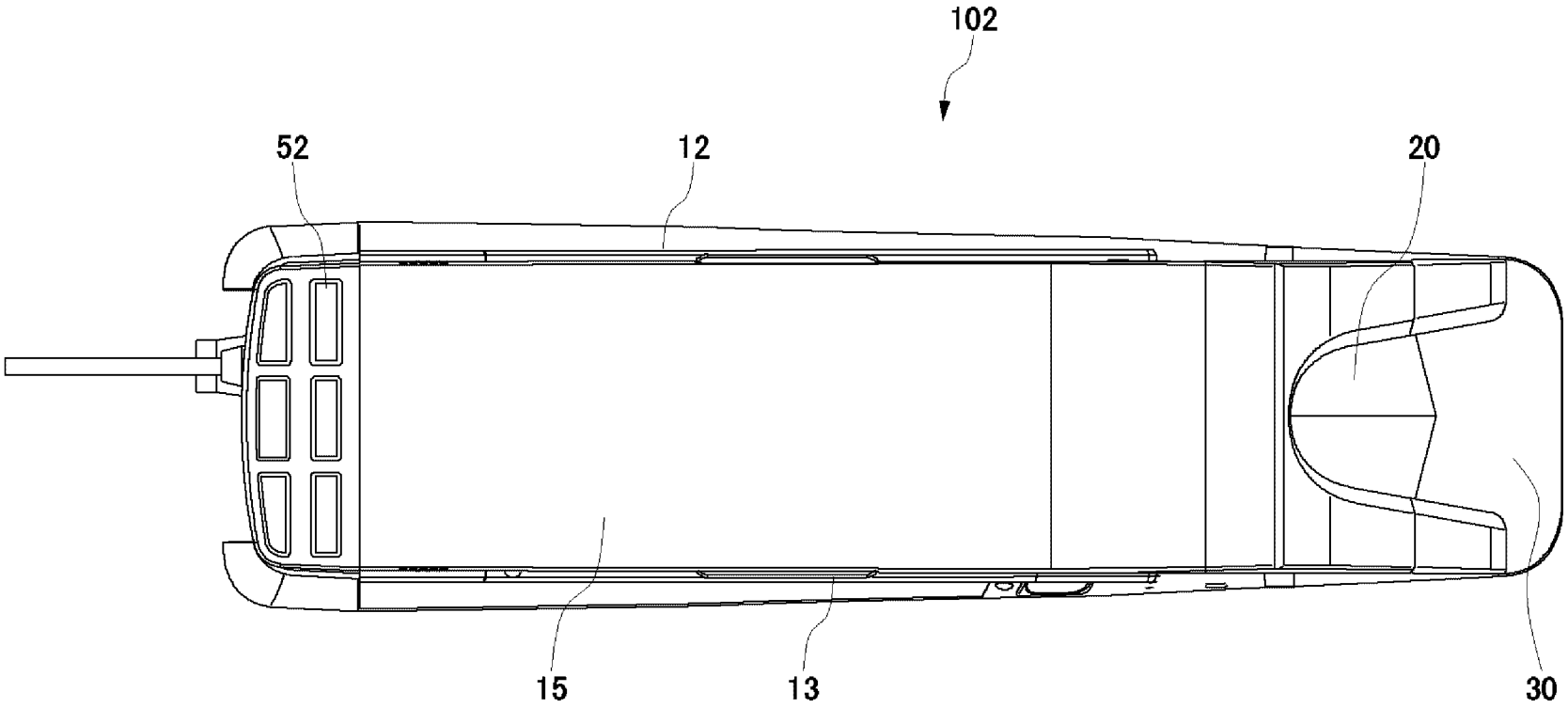
FIG. 26 is a plan view showing the electronic shoe according to the third embodiment of the present invention.
Figure 27:
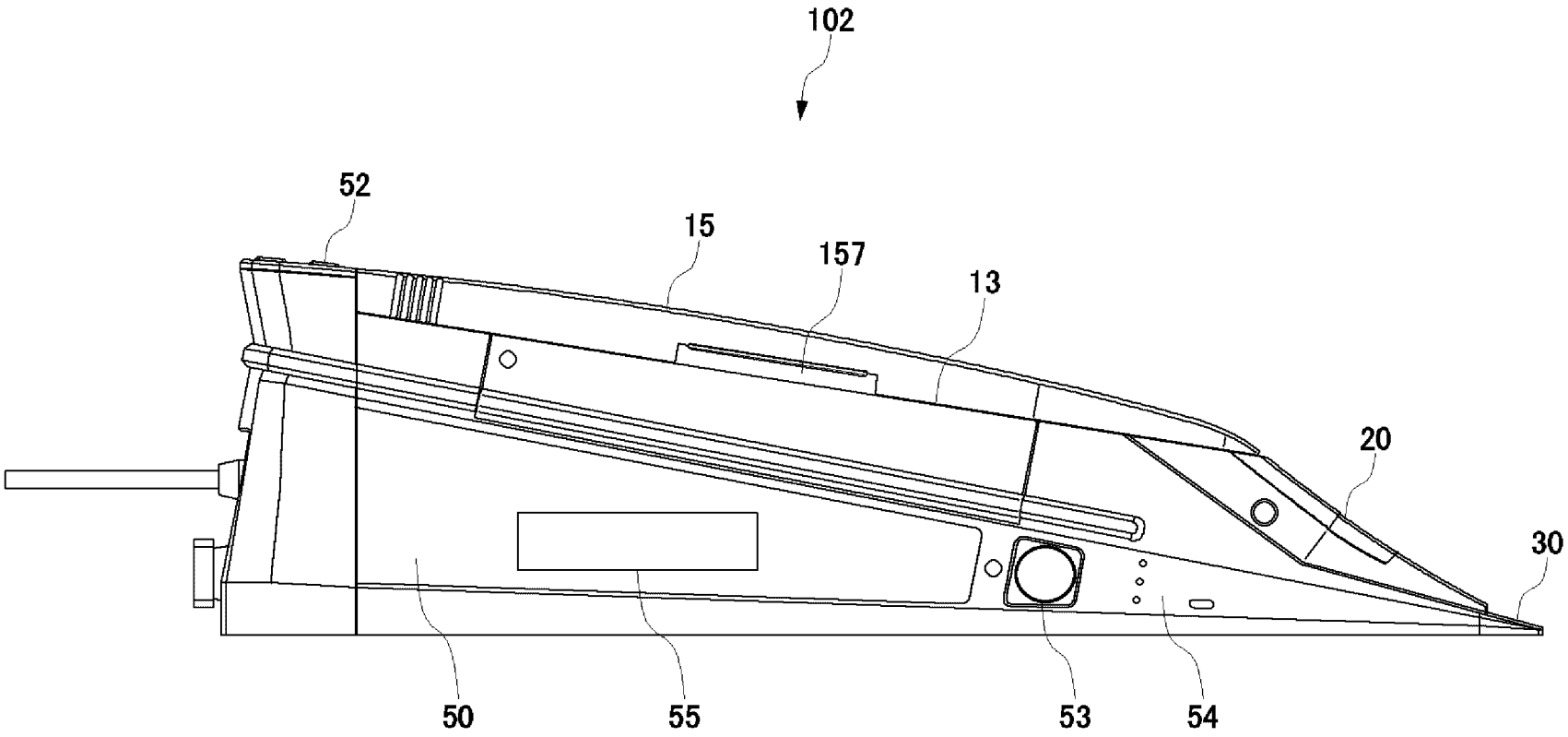
FIG. 27 is a right side view showing the electronic shoe according to the third embodiment of the present invention.
Figure 28:
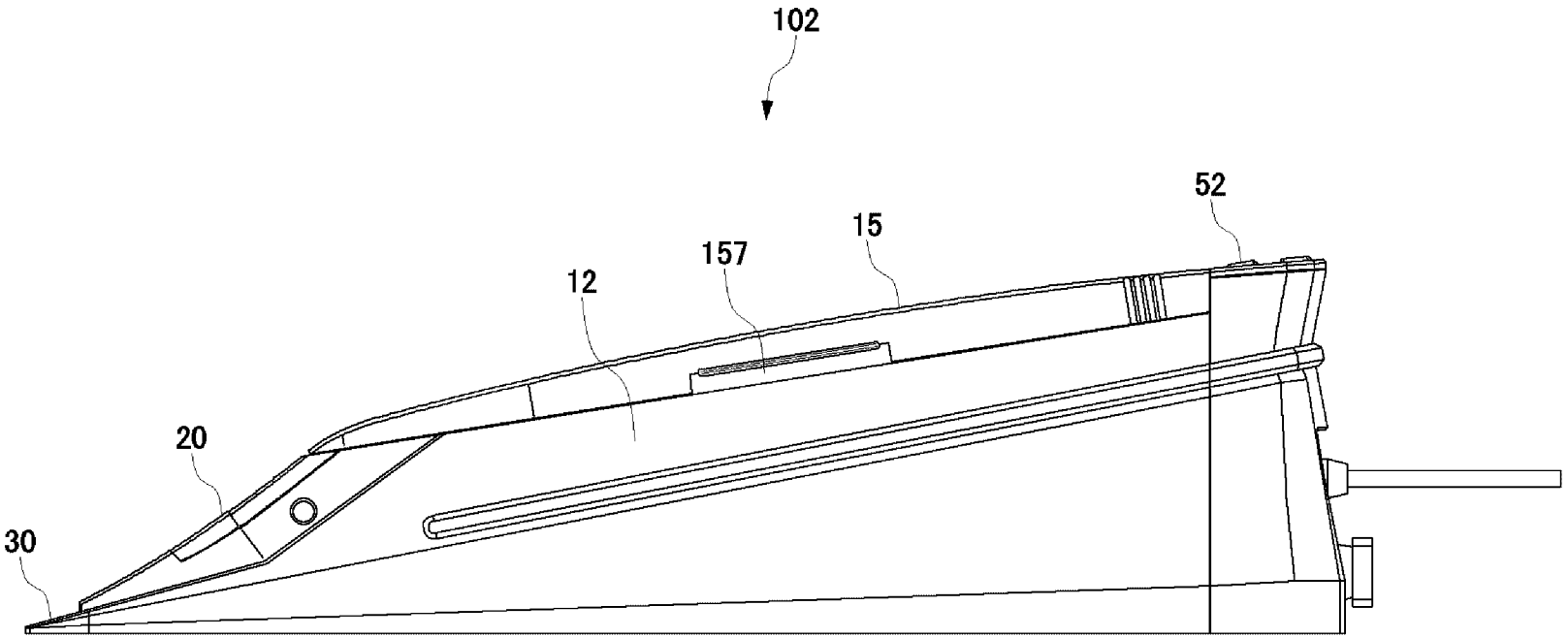
FIG. 28 is a left side view showing the electronic shoe according to the third embodiment of the present invention.
Figure 29:
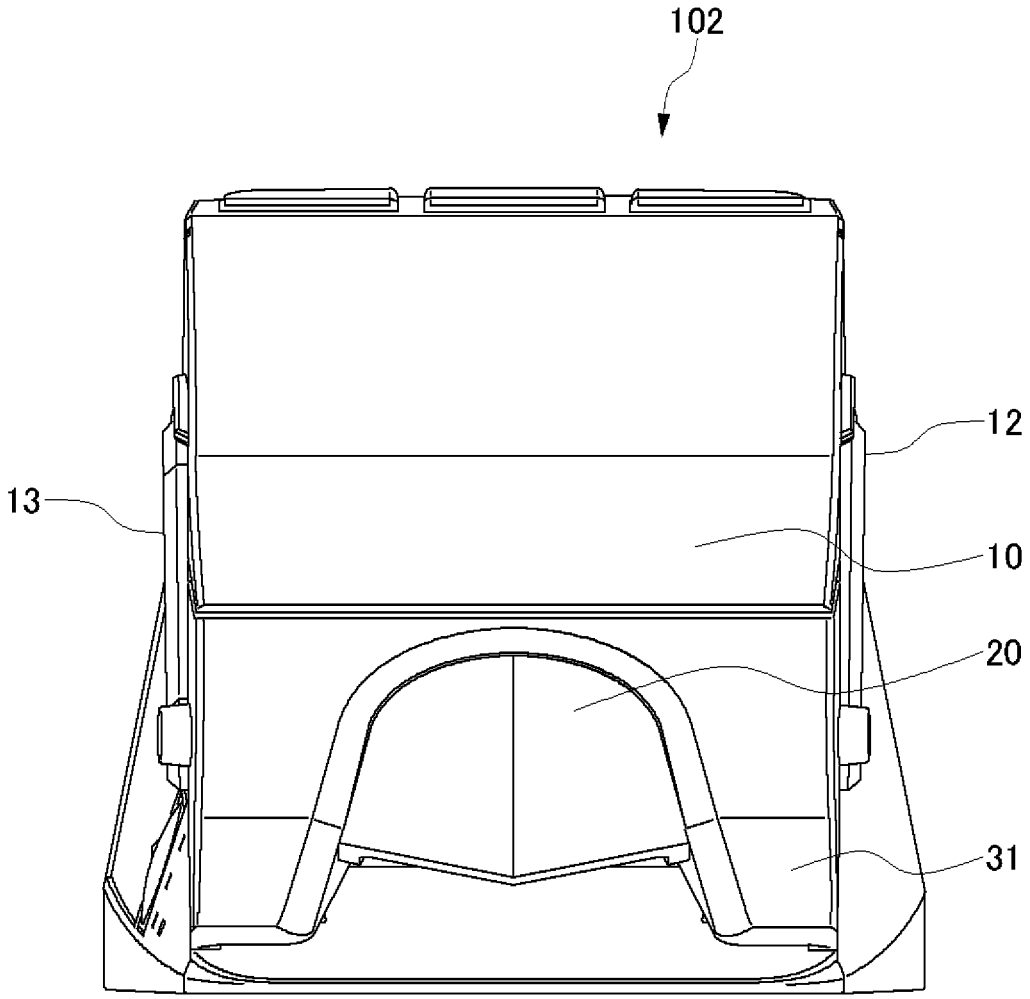
FIG. 29 is a front view showing the electronic shoe according to the third embodiment of the present invention.
Figure 30:
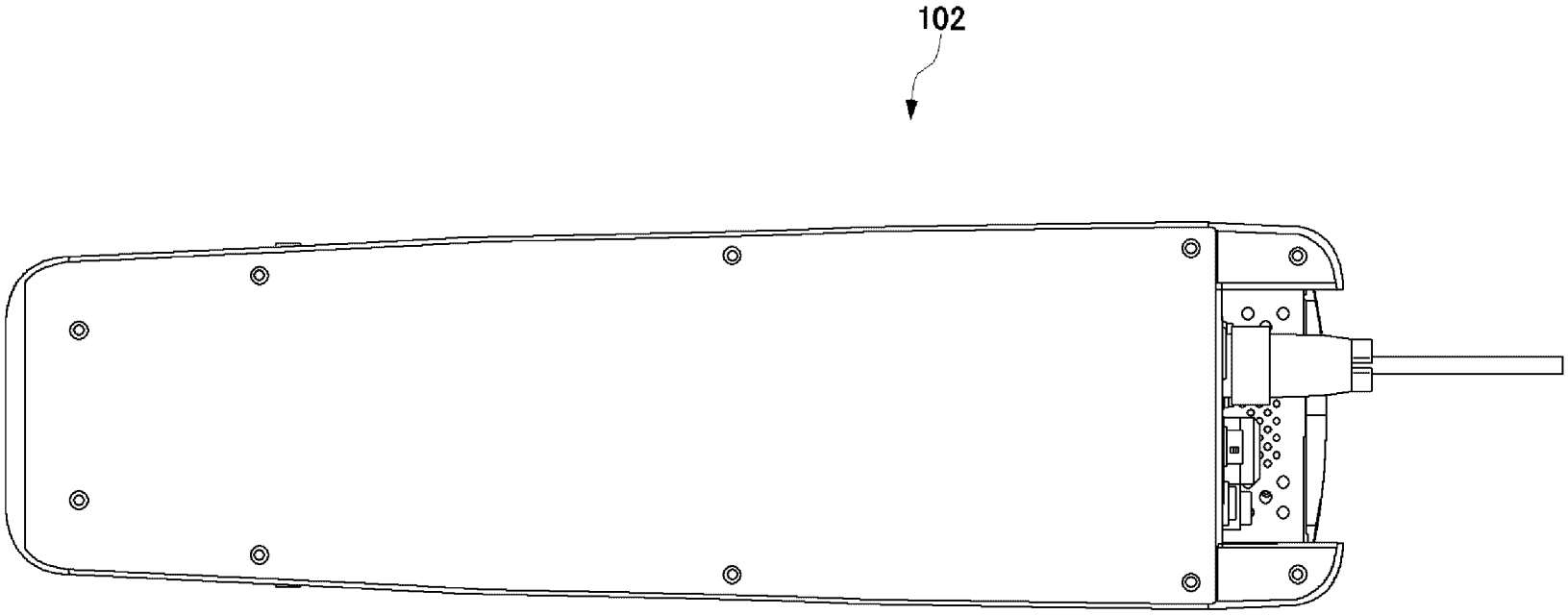
FIG. 30 is a bottom view showing the electronic shoe according to the third embodiment of the present invention.

FIGS. 24A and 24B are views explaining a backflow in a prior electronic shoe. In an example in FIGS. 24A and 24B, the upper surfaces of a plurality of playing cards housed in the housing portion are covered by a flat ceiling 150. In such a case, as shown in FIG. 24A, when a leading playing card is pushed up with the finger, the front end of the leading playing card enters along the ceiling 150 into a space between the ceiling 150 and the upper ends of a second and rear playing cards to rise, and the lower end portion of the second playing card is exposed. Whereby, the finger can contact the second playing card, and skip the leading playing card and draw the second playing card, as shown in FIG. 24B.

In contrast, in the present embodiment, the backflow of the leading playing card is restricted by the backflow stopper 112, and so it is impossible to contact and draw out the second playing card, and it is prevented that the illicitness that the playing card is drawn in a different order from the original order.

In the second embodiment of the present invention, the following techniques are disclosed.

(1) A security electronic shoe for a casino configured to house a plurality of playing cards to be drawn one by one for a game, comprising: a housing portion configured to house a stacked plurality of playing cards; an opening portion configured to expose a leading playing card among the plurality of playing cards housed in the housing portion; a draw guide portion configured to guide draw of the leading playing card from the opening portion; a weight configured to push a last playing card of the plurality of playing cards toward the opening portion; and an upper surface cover configured to be slidable between a cover position where the upper surface cover covers upper surfaces of the plurality of playing cards and an open position where the upper surface cover opens the upper surfaces of the plurality of playing cards, wherein the bottom portion of the housing portion slopes so as to descend toward the opening portion, the weight is configured to be movable on the bottom portion of the housing portion toward the opening portion in a state pushing the last playing card toward the opening portion, according to that the last playing card moves toward the opening portion, accompanying that the leading playing card is drawn in sequence, the bottom portion of the housing portion includes a weight stopper configured to hold the weight in a holding position at an upper portion by contacting a front end of the weight, and the weight is configured that a holding state of the weight in the holding position is released by positioning the upper surface cover in the cover position and the weight moves toward the opening portion by its own weight to push the last playing card toward the opening portion.

(2) The security electronic shoe for the casino according to (1), wherein the upper surface cover includes a push-down protrusion on an inner surface, and when the upper surface cover is positioned in the cover position, the push-down protrusion pushes down a rear end portion of an upper surface of the weight held in the holding position by the weight stopper, the front end of the weight crosses over the weight stopper by principle of leverage, and the weight moves toward the opening portion by its own weight to push the last playing card toward the opening portion.

(3) The security electronic shoe for the casino according to (1) or (2), wherein the weight includes an eave portion extending rearward from the upper surface.

(4) The security electronic shoe for the casino according to any of (1) to (3), wherein weight stoppers are provided on both sides of the bottom portion of the housing portion.

(5) The security electronic shoe for the casino according to any of (1) to (4), wherein the weight stopper is provided at a position where a gap is secured between a rear end of the weight and a rear end of the housing portion when the weight is held in the holding position.

(6) A security electronic shoe for a casino configured to house a plurality of playing cards to be drawn one by one for a game, comprising: a housing portion configured to house a stacked plurality of playing cards; an opening portion configured to expose a leading playing card among the plurality of playing cards housed in the housing portion; a draw guide portion configured to guide draw of the leading playing card from the opening portion; and a weight configured to push a last playing card of the plurality of playing cards toward the opening portion, wherein an upper portion of a front end of the housing portion is provided with a backflow stopper configured to restrict a backflow of the leading playing card housed in the housing portion.

(7) The security electronic shoe for the casino according to (6), wherein the backflow stopper is provided so as to be covered over an opened portion of an upper surface of the housing portion.

(8) The security electronic shoe for the casino according to (6) or (7), wherein the backflow stopper includes a base end portion extending rearward and upward, and in a direction substantially parallel to a plane direction of the playing cards housed in the housing portion, and a backflow restricting portion contiguous from a tip end of the base end portion and bent downward at a substantially right angle.

An electronic shoe according to the third embodiment of the present invention is described below. FIGS. 25-31 are a perspective view, a plan view, a right side view, a left side view, a front view, a bottom view, and a rear view showing the electronic shoe according to the third embodiment of the present invention. FIG. 32 is a perspective view showing the electronic shoe in a state in which an upper surface cover is removed according to the third embodiment of the present invention.

In the electronic shoe according to the third embodiment, the same reference mark is given to the same structure as that of the electronic shoe according to the second embodiment, and explanations thereof are appropriately omitted. A basic structure of the electronic shoe 102 according to the present embodiment is the same as that of the electronic shoe 101 according to the second embodiment. The electronic shoe 102 includes a housing portion 10, an opening portion 20, a draw guide portion 30, a weight 40, and a main body 50.

In the electronic shoe 102 according to the present embodiment, comparing with the electronic shoe 101 according to the second embodiment, in corner portions of the front end of the draw guide portion 30, the corners are removed, and those are shaped to be rounded. Whereby, it is easier that an open-hand operation that a dealer draws a playing card C from the electronic shoe 102 and simultaneously turns over the playing card C to face the front side up. That is, when the dealer draws out the playing card C with the index finger of the right hand while contacting the ball of the thumb of the right hand with the corner portion on the side of the dealer, the dealer contacts the front side of the playing card C with the thumb and the back side of the drawn card C with the index finger, and can pick up the playing card C, and can easily perform an action of turning over the playing card C subsequently to it.

The electronic shoe 102 in the present embodiment includes magnets respectively built into the rear end of an upper surface cover 15 and the rear end portion of the housing portion 10 which contacts the rear end of the upper surface cover 15 when the upper surface cover 15 is installed. Whereby, a position of the upper surface cover 15 is held by magnetic force of the magnets in a state in which it is installed in the electronic shoe 102. The upper surface cover 15 can be easily removed by sliding the upper surface cover 15 against the magnetic force of the magnets.

In the electronic shoe 102 according to the present embodiment, a metal reinforcing plate is built into each of a side surface cover 13 and a side wall portion integrally forming the side surface together with the side surface cover 13. Whereby, when gripping the side surface cover 13 and the portion of a side wall 12 opposite thereto to lift the electronic shoe 102, even in the case where inward pressure is applied to the side surface cover 13, it is possible to reduce deformation of the side surface cover 13.

In the electronic shoe 102 according to the present embodiment, a protrusion 157 extending in the forward and reward direction is formed on the outside of the side surface of the upper surface cover 15. Whereby, it is facilitated to hang the finger on this protrusion 157 to lift the electronic shoe 102 in a state in which the upper surface cover 15 is installed.

Figure 31:
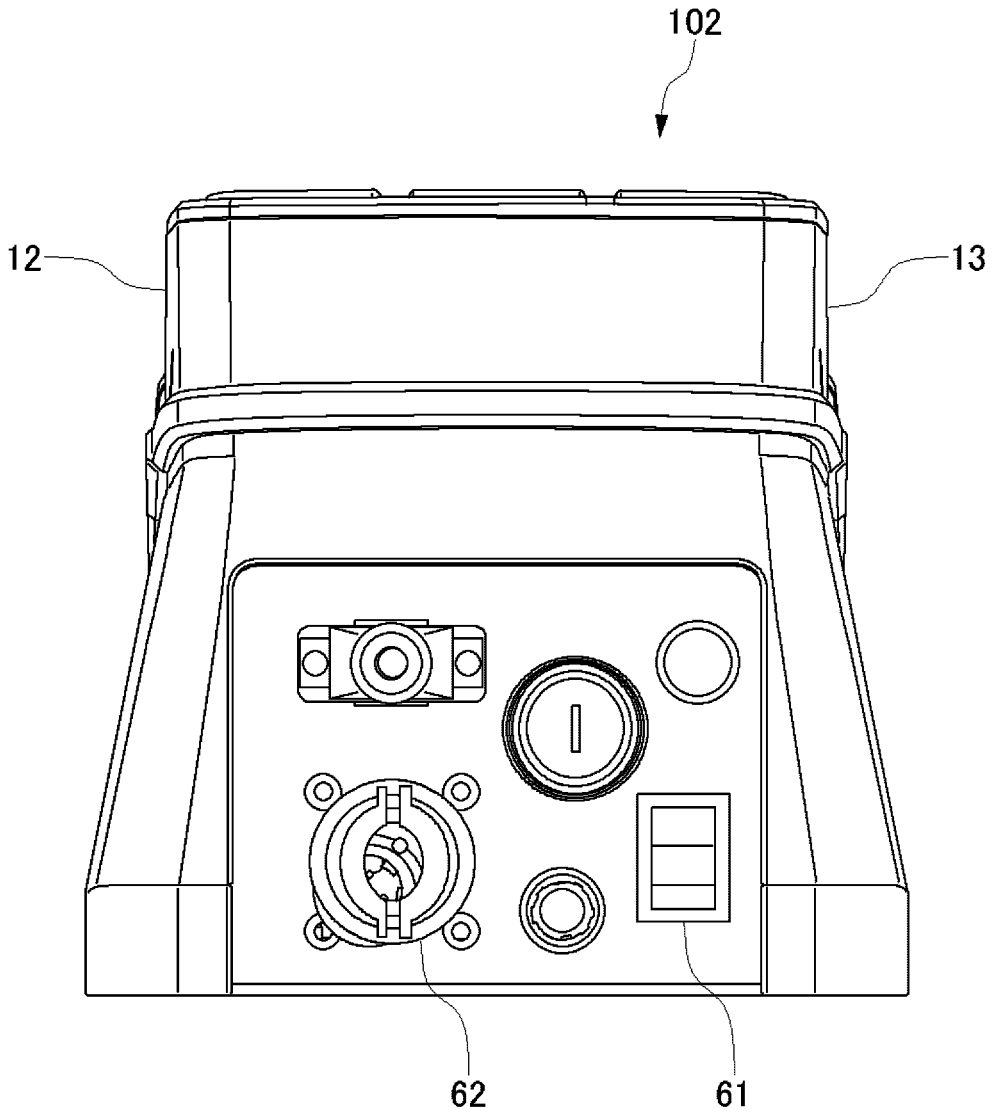
FIG. 31 is a rear view showing the electronic shoe according to the third embodiment of the present invention.
Figure 32:
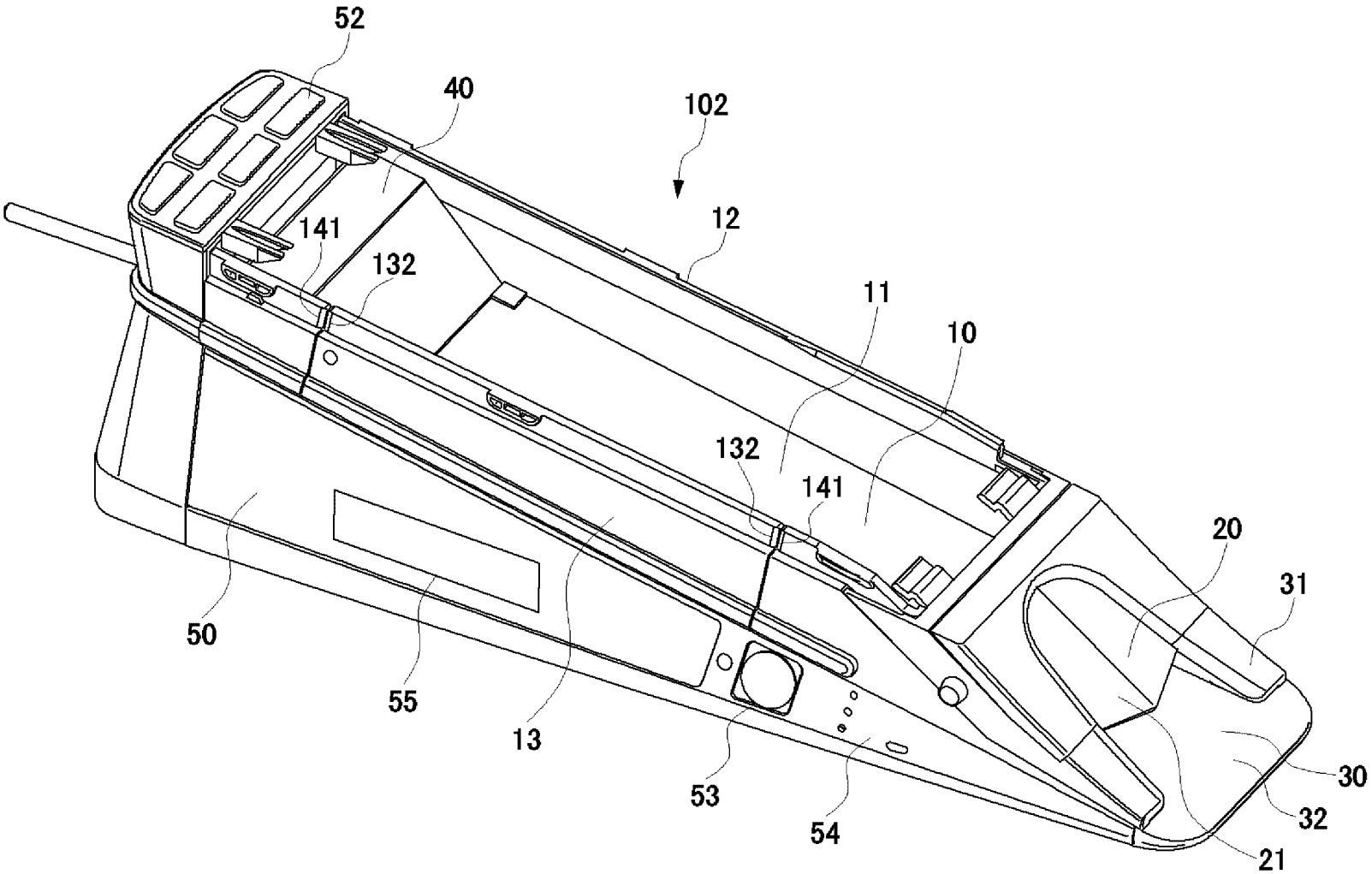
FIG. 32 is a perspective view showing the electronic shoe in a state in which an upper surface cover is removed according to the third embodiment of the present invention.

As shown in FIG. 31, the back surface of the electronic shoe 102 includes a connector 62 for connecting with an external device and a power switch 61 of the electronic shoe 102.

As shown in FIG. 32, chamfering is performed to outer portions 132 of the upper ends of the front and rear ends of the side surface cover 13 and portions 141 of a side wall 14 opposite to the outer portions 132 of the side surface cover 13. Whereby, it is prevented that the inner side surface of the upper surface cover 15 is caught by a step at a boundary between the upper end of this side surface cover 13 and the side wall 14 to hinder a smooth sliding in a process in which the upper surface cover 15 slides to the closed position.

Figure 33:
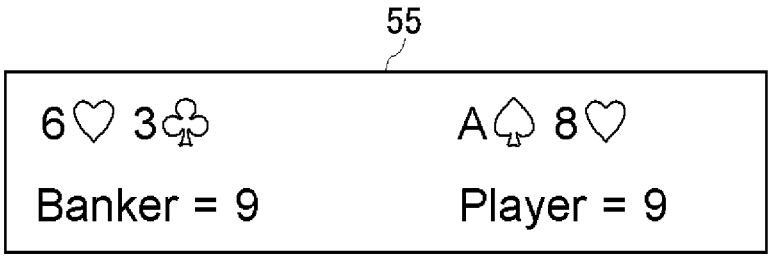
FIG. 33 is a view showing an indicating example of a result indicating display according to the third embodiment of the present invention.

FIG. 33 is a view showing an indicating example of a result indicating display according to the third embodiment of the present invention. The result indicating display 55 according to the present embodiment indicates information in two rows. Specifically, in the result indicating display 55, as a game result, ranks and suits of two playing cards C which is banker hand are indicated in the upper row on the left side and a number of an units digit of a total value of ranks of two playing cards C which is banker hand is indicated in the lower row, and ranks and suits of two playing cards C which is player hand are indicated in the upper row on the right side and a number of an units digit of a total value of ranks of two playing cards C which is player hand is indicated in the lower row.

The electronic shoe 102 according to the present embodiment is provided with, as a result indicating lamp 54, a lamp for indicating banker 6 as well as lamps for indicating the respective results of player win, banker win, and tie. Banker 6 means that a hand of banker wins by 6. In this case, even when betting on the banker win, an amount of chips to be paid out is a half amount of a bet amount. In a case where a bet area is provided with a bet area for betting on that the banker wins by 6 (called "super 6", "lucky 6", and so on), payment is performed for chips bet thereon at a multiplier greater than 1 time (for example, 24 times).

In this may, when the banker 6 occurs, the dealer must perform a different payment operation from that at normal time. Therefore, the electronic shoe 102 according to the present embodiment is provided with a lamp for indicating that the banker 6 occurs as one of the result indicating lamps 54.

Figure 34:
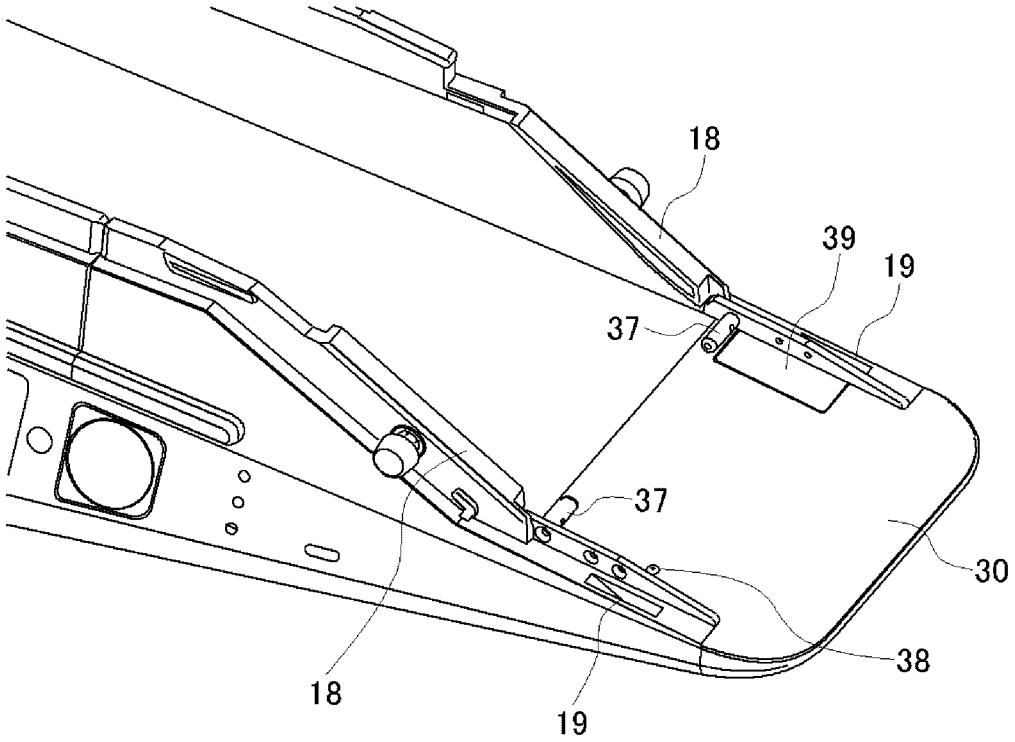
FIG. 34 is a view showing the detail of a draw guide portion according to the third embodiment of the present invention.

FIG. 34 is a view showing a detail of the draw guide portion according to the third embodiment of the present invention. In FIG. 34, an inside structure of a restricting portion 31 is shown in a state in which the restricting portion 31 is removed. Each of the front end portions of the side walls 12 and 14 includes a restraining portion 18 for restraining lifting of housed playing cards C. The lower surface of this restraining portion 18 has a curved shape convex downward. By this structure, the front end of a leading playing card C stops in front of a restricting bar 37, and it is not that the leading playing card C housed in the housing portion 10 is pressed against the restricting bar 37 by its own weight and the pressure of the weight 40.

By such structure, the playing card C does not hinder when removing the restricting portion 31 as is shown in FIG. 34 and maintaining the restricting bar 37. That is, for the height of the restricting bar 37, a precise adjustment is necessary in order to prevent two cards draw. Therefore, the adjustment may be necessary in a process of using the electronic shoe 102, and, even in such case, the leading playing card C does not contact with the restricting bar 37, and so it is possible to adjust the restricting bar 37 without removing the playing cards C from the housing portion 10.

As shown in FIG. 34, the electronic shoe 102 according to the present invention is provided with a sensor cover 39 covering code reading sensors 33 and 34 and card detecting sensors 35 and 36. The periphery portion of the sensor cover 39 is provided with a packing in order to prevent paper dust of the playing card C from entering the interior. The sensor cover 39 is formed of transparent material.

In order to prevent the paper dust of the playing card C from entering the code reading sensors 33 and 34 and card detecting sensors 35 and 36, a sponge-like dustproof member or seal member surrounds the peripheries of sensor chips on a sensor substrate.

Figure 35:
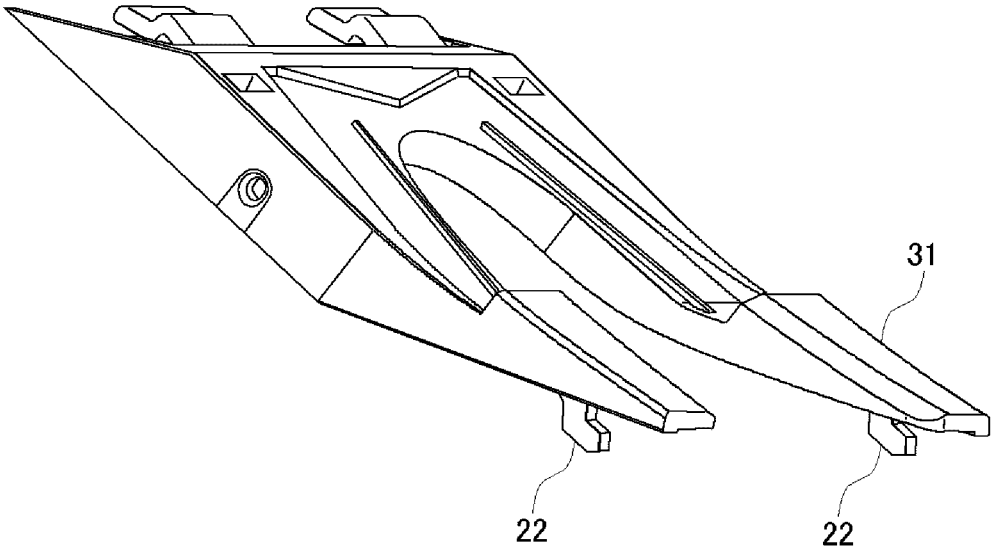
FIG. 35 is a perspective view showing a restricting portion according to the third embodiment of the present invention.

FIG. 35 is a perspective view showing the restricting portion according to the third embodiment of the present invention. The restricting portion 31 has a generally fork-shaped shape, and the lower surfaces of the front end portions thereof are provided with engaging claws 22. These engaging claws 22 engage claw receiving holes 19 formed at the front end portions of the side walls 12 and 14. These engaging claws 22 of the restricting portion 31 engage with the claw receiving holes 19 of the side walls 12 and 14, and so it is prevented that the front end portions of the side walls 12 and 14 are spread to the outside of the left and right and the front end portions of the restricting portion 31 are lifted up.

Figure 36:
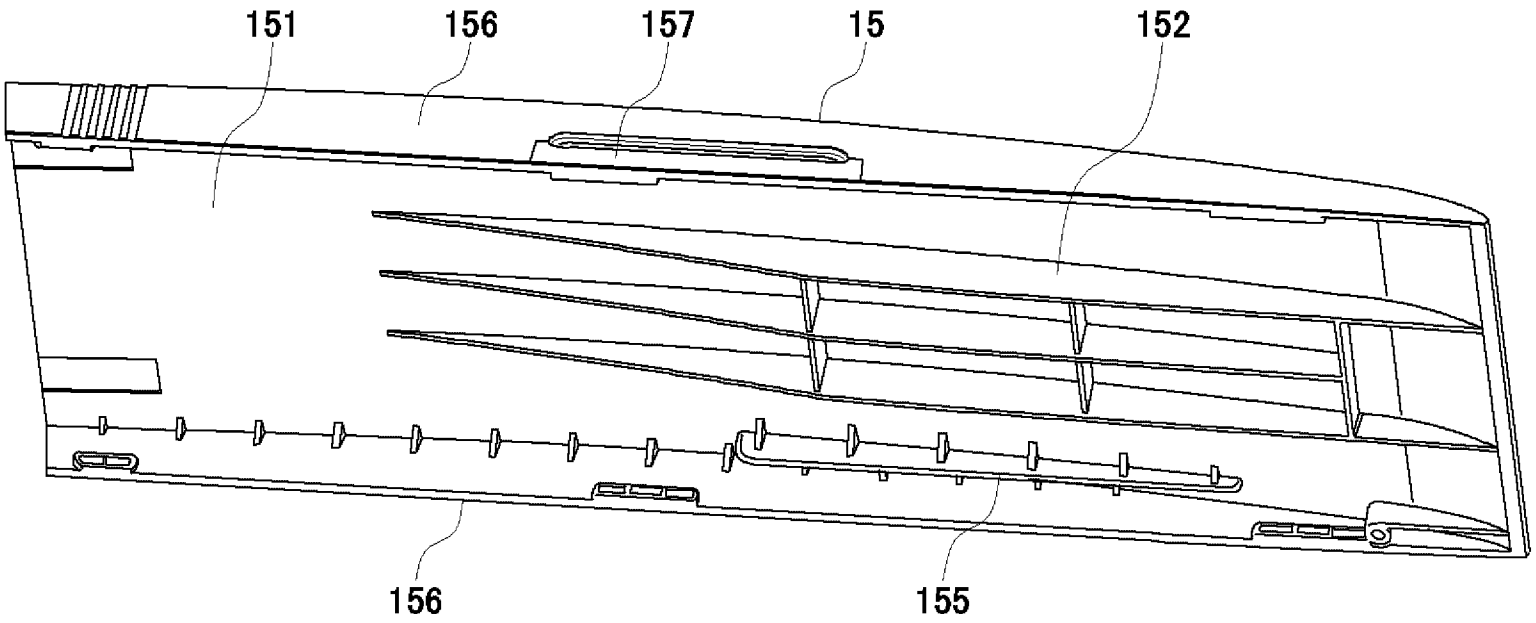
FIG. 36 is a perspective view showing the upper surface cover according to the third embodiment of the present invention.

FIG. 36 is a perspective view showing the upper surface cover according to the third embodiment of the present invention. A plurality of ribs 152 is formed on the inner surface 151 of the upper surface cover 15. In addition to this, guides 155 extending in the longitudinal direction is formed at positions close to the left and right side walls 156 on the inner surface 151. When the upper surface cover 15 is installed to the electronic shoe 102, the upper ends of the side walls 12, 14 and the side surface cover 13 are inserted into gaps between the guides 155 and the left and right side walls 156.

That is, in the state in which the upper surface cover 15 is installed, the upper ends of the side walls 12, 14 and side surface cover 13 fit into and fixed in the gaps between the guides 155 formed on the inner surface 151 of the upper surface cover 15 and the side wall 156. Therefore, in the state in which the upper surface cover 15 is installed, the side walls 12, 14 and side surface cover 13 and the upper surface cover 15 are firmly fixed, and, together with the action of the metal reinforcing plate described above, it is possible to reduce deformation when the electronic shoe 102 is lifted.

In baccarat game in which the electronic shoe 102 is used, there are a type of a game operation called squeeze baccarat in which a player is permitted to open a playing card C drawn from the electronic shoe 102, and a type of a game operation called open hand baccarat in which the dealer oneself opens a playing card C drawn from the electronic shoe 102. In the case of the open hand baccarat, the dealer opens the playing card C drawn from the electronic shoe 102. In the case of the open hand baccarat, the dealer draws a playing card C from the electronic shoe 102 and simultaneously opens the playing card C and places it on the gaming table.

Figure 37:
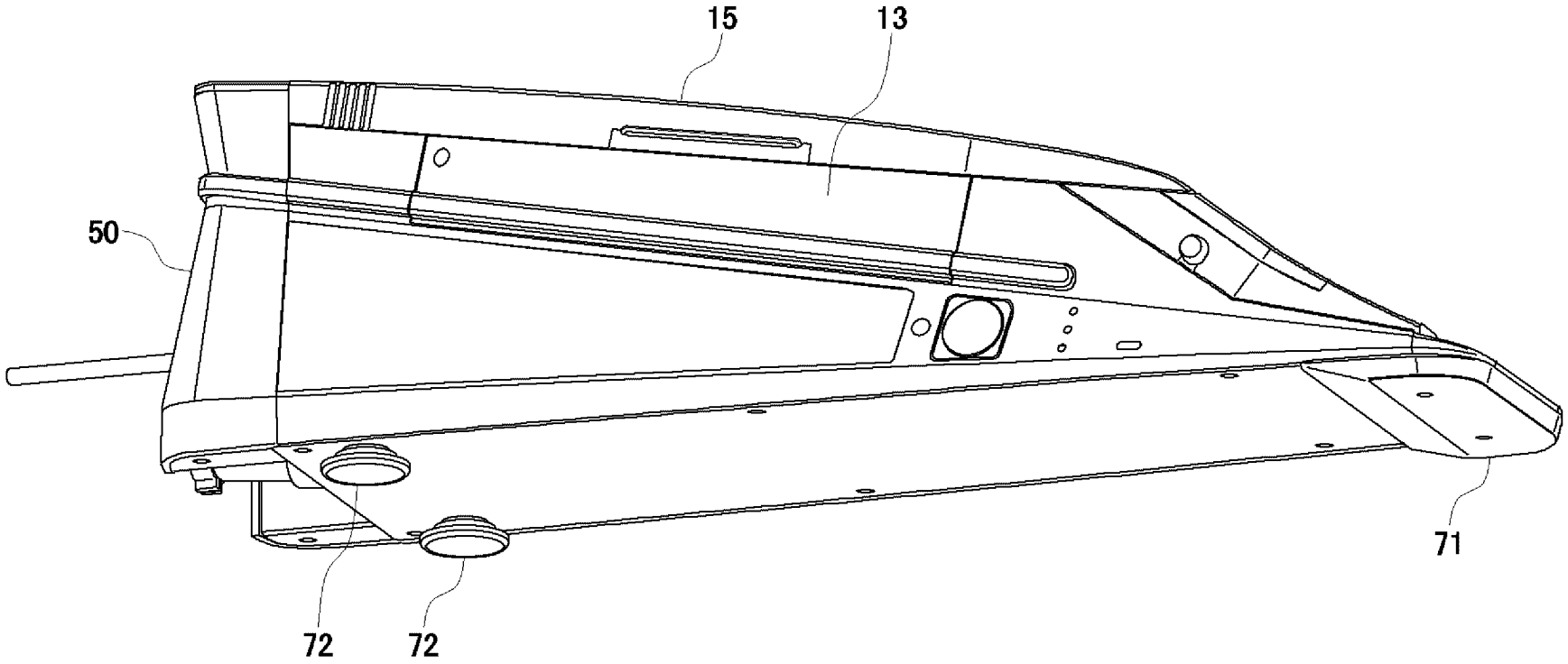
FIG. 37 is a perspective view showing the electronic shoe according to the third embodiment of the present invention.

FIG. 37 is a perspective view showing the electronic shoe according to the third embodiment of the present invention. In the case of the above open hand, the bottom surface of the electronic shoe 102 is installed with bottom raising parts 71 and 72 raising the bottom surface of the electronic shoe 102. Whereby, the height of the upper surface of the draw guide portion 30 on which the playing card C to be drawn slides from a table surface of the gaming table become higher, and so it become easier for the dealer to pick up the drawn card.

The bottom raising part 71 is installed to the front end portion of the bottom surface, and the two bottom raising parts 72 are installed to the left and right of the rear end portion of the bottom surface. The bottom raising part 71 may be installed to the bottom surface by a screw, and the bottom raising part 72 may be installed to the bottom surface by itself as a screw.

In the electronic shoe 102 according to the present embodiment, as is in the electronic shoe 101 according to the second embodiment, when the upper surface cover 15 is closed, holding of the weight 40 at the upper portion of the housing portion 10 is released, and the weight 40 slides down in the housing portion 10 to press the last of the housed playing cards C forward. In this way, it is that a structure in which the weight 40 slides down by installing the upper surface cover and so the user cannot visually confirm whether the weight 40 become indeed in a state in which it slides down and pushes the playing cards C forward.

Therefore, an observation window may be provided on the upper surface cover 15. This observation window may be provided at the upper portion of the upper surface cover 15 and it may be possible to observe the weight 40 held at the upper end portion of the housing portion Whereby, when the upper surface cover 15 is installed to the electronic shoe 102 and the weight 40 slides downward, the user cannot observe the weight 40 through the observation window, and so check that the weight 40 slid downward.

Instead of the observation window, it may be used that a sensor configured to detect that the weight 40 slid from a holding position. For example, it may be to provide a sensor formed of an LED light and a photodiode sensor at a position corresponding to the weight 40 and detect presence or absence of the weight 40 in the holding position.

A computer is built in the main body 50 of the electronic shoe 102 according to the present embodiment. This computer includes an arithmetic processor, memory, and storage device, and, as a processing portion of the electronic shoe 102, activates by a program according to the present embodiment and performs the following information processing. First, the processing portion stores information on ranks of drawn cards and game results as log information in the storage device together with information on a date and time of the game. Moreover, when the processing portion detects that the upper surface cover 15 is opened or closed as well as when some error occurs, it stores those events as the log information in the storage device together with the information of the date and time.

Furthermore, in the processing portion, analyzing software configured to analyze this log information may be ran. This analyzing software may, for example, perform statistical processing on the game results or on the ranks of the drawn playing cards C.

The processing portion is connected to an external computer through the connector 62. Whereby, the external computer can read out various log information stored in the storage device by connecting to the processing portion through the connector 62. Therefore, the processing portion has a security function in order to allow to export the log information only to trusted external computer. Specifically, an ID and password are set to the processing portion, and only when these ID and password are input from connected external computer, it communicates with the external computer.

The processing portion obtains information on the ranks of the drawn playing cards C from the code reading sensors 33 and 34. As described above, the two rows of marks M1 and M2 are printed on the playing card C by UV ink, and the code reading sensors 33 and 34 read these marks M1 and M2 to obtain the information on the ranks. At this time, it is set that a threshold value by which the sensors determine presence or absence of marks in marks M1 and M2.

The processing portion runs a program for teaching the threshold value for determining the presence or absence of these marks for the code reading sensors 33 and 34. Previously, a threshold value is set by operating each of a plurality of sensors. In the electronic shoe 102 according to the present embodiment, the teaching can be performed at once for this plurality of code reading sensors 33 and 34 by the processing portion or the external computer connected to the processing portion.

In this teaching, the playing card C is set at a position where the mark M1 is read by the code reading sensor 33, a reading value of the code reading sensor 33 is obtained, and the threshold value of the code reading sensor 33 is set based on this. In the same way, the playing card C is set at a position where the mark M2 is read by the code reading sensor 34, a reading value of the code reading sensor 34 is obtained, and the threshold value of the code reading sensor 34 is set based on this.

In the teaching, the processor may alternatively obtain a change in a reading value of the code reading sensors 33 and 34 (values of areas in which the marks M1 and M2 are present and absent) while drawing the playing card C, and set the threshold value based on this reading value.

The processing portion or the external computer connected to the processing portion also perform teaching for color tone of the playing card C. In this teaching, for example, about 20 playing cards C are drawn, the code reading sensors 33 and 34 perform reading during this, and so the processing portion determines the color tone of the playing card C and adjust the white balance.

The invention claimed is:

1. A security electronic shoe for a casino configured to house a plurality of playing cards to be drawn one by one for a game, comprising:

a housing portion configured to house a stacked plurality of playing card;

an opening portion configured to expose a leading playing card among the plurality of playing cards housed in the housing portion;

a draw guide portion configured to guide draw of the leading playing card from the opening portion;

a weight configured to push a last playing card of the plurality of playing cards toward the opening portion;

a side surface cover configured to be movable between a cover position where the side surface cover covers an opening of a side surface of the housing portion and an open position where the side surface cover opens the opening of the side surface of the housing portion; and an upper surface cover configured to be fixable in a cover position where the upper surface cover covers an opening of an upper surface of the housing portion, wherein:

a bottom portion of the housing portion slopes so as to descend toward the opening portion, the weight is configured to be movable on the bottom portion of the housing portion toward the opening portion in a state pushing the last playing card toward the opening portion, according to that the last playing card moves toward the opening portion, accompanying that the leading playing card is drawn in sequence, the housing portion has a structure in which when the upper surface and the side surface are opened to reveal an opened portion in the housing portion, the plurality of playing cards can be loaded into the housing portion through the opened portion, and the side surface cover and the upper surface cover are configured as separate parts.

2. The security electronic shoe for the casino according to claim 1, wherein the side surface cover can perform a rotating movement between the cover position and the open position.

3. The security electronic shoe for the casino according to claim 1, wherein the side surface cover can perform a parallel movement between the cover position and the open position.

4. The security electronic shoe for the casino according to claim 1, wherein the side surface is a side surface on a right side facing in a direction of the draw.

5. The security electronic shoe for the casino according to claim 1, wherein the draw guide portion is configured to be removable.

6. The security electronic shoe for the casino according to claim 1, wherein the draw guide portion includes a metal part configured to restrain the playing card to be drawn to prevent two playing cards from being drawn at a same time.

7. The security electronic shoe for the casino according to claim 1, wherein the upper surface cover is configured to be movable between the cover position where the upper surface cover covers upper surfaces of the plurality of playing cards and an open position where the upper surface cover opens the upper surfaces of the plurality of playing cards.

8. The security electronic shoe for the casino according to claim 1 wherein the upper surface cover is configured to be fixable in the cover position of the upper surface cover by positioning the side surface cover in the cover position of the side surface cover.

9. The security electronic shoe for the casino according to claim 1, wherein the housing portion includes a holding means configured to hold the weight in a rear position of the housing portion in order to load the plurality of playing cards into the housing portion.

10. The security electronic shoe for the casino according to claim 9, wherein the holding means is configured to release holding of the weight according to that the upper surface cover comes to the cover position.

11. The security electronic shoe for the casino according to claim 1, wherein the housing portion includes a stopper at a position of the plurality of playing cards corresponding to a lower portion of the opened side surface, the stopper configured to restrict a lateral movement of the plurality of playing cards.

12. The security electronic shoe for the casino according to claim 11, wherein:

the plurality of playing cards is to be housed in the housing portion such that back surfaces thereof face the opening portion, and the weight is configured to contact with a front surface of the last playing card such that the front surface of the last playing card cannot be seen.

13. The security electronic shoe for the casino according to claim 11, wherein a surface of the side surface cover opposed to the side surface is positioned more outside than a surface of the stopper opposed to the side surface when the side surface cover is in the cover position.

* * * * *